US007748990B2

(12) United States Patent
Tutt et al.

(10) Patent No.: US 7,748,990 B2
(45) **Date of Patent: *Jul. 6, 2010**

(54) HIGH FREQUENCY CONNECTOR ASSEMBLY

(75) Inventors: Christopher Alan Tutt, St. Augustine, FL (US); Kenneth J. Peters, St. Augustine, FL (US); Thomas P. Dix, Jerico, VT (US)

(73) Assignee: Tensolite, LLC, Saint Augustine, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/403,798

(22) Filed: Mar. 13, 2009

(65) Prior Publication Data

US 2009/0176410 A1 Jul. 9, 2009

Related U.S. Application Data

(63) Continuation of application No. 11/669,703, filed on Jan. 31, 2007, now Pat. No. 7,503,768, which is a continuation-in-part of application No. 11/133,862, filed on May 20, 2005, now Pat. No. 7,404,718, which is a continuation-in-part of application No. 10/702,192, filed on Nov. 5, 2003, now Pat. No. 7,074,047.

(51) Int. Cl.
*H01R 12/00* (2006.01)

(52) U.S. Cl. ..... 439/66

(58) Field of Classification Search ..... 439/66, 439/63, 91, 65, 579, 381
See application file for complete search history.

(56) References Cited

U.S. PATENT DOCUMENTS 3,587,033 A 6/1971 Brorein et al.
3,665,601 A 5/1972 Dunbabin
3,685,026 A 8/1972 Wakabayashi (Continued)

FOREIGN PATENT DOCUMENTS

EP 0542102 2/1996

(Continued)

OTHER PUBLICATIONS

Daane, L. and Greenstein, M., A Demountable Interconnect System for a 50 × 50 Ultrasonic Imaging Transducer Array, IEEE Transactions on Ultrasonics, Ferroelectrics and Frequency Control, Sep. 1997, pp. 978-982.

(Continued)

*Primary Examiner*—Phuong K Dinh
(74) *Attorney, Agent, or Firm*—Wood, Herron & Evans, LLP

(57) ABSTRACT

A connector assembly includes a signal array of a plurality of conductors, each conductor including at least one inner conductive element and an outer conductive element. A connector body has a front surface and the inner and outer conductive elements are electrically presented proximate the front surface in a generally co-planar arrangement. The inner and outer conductive elements terminate in a face surface that is raised above the front surface of the connector body. A compressible interface element has a plurality of conductive elements embedded in a compressible, electrically insulative medium. The interface element is positionable against the face to be compressed between the signal array and a signal bearing component to pass signals between the signal array and the signal-bearing component.

25 Claims, 15 Drawing Sheets

U.S. PATENT DOCUMENTS

| | | | |
|---|---|---|---|
| 3,711,794 | A | 1/1973 | Harnden et al. |
| 4,125,308 | A | 11/1978 | Schilling |
| 4,534,602 | A | 8/1985 | Bley |
| 4,556,265 | A | 12/1985 | Cunningham |
| 4,596,432 | A | 6/1986 | Tighe |
| 4,626,492 | A | 12/1986 | Eilbeck |
| 4,653,840 | A | 3/1987 | Grabbe |
| 4,692,561 | A | 9/1987 | Nattel |
| 4,695,258 | A | 9/1987 | Hanson |
| 4,754,546 | A | 7/1988 | Lee et al. |
| 4,820,376 | A | 4/1989 | Lambert et al. |
| 4,932,883 | A | 6/1990 | Hsia et al. |
| 4,952,173 | A | 8/1990 | Peronnet |
| 4,952,174 | A | 8/1990 | Sucht |
| 5,045,249 | A | 9/1991 | Jin et al. |
| 5,046,966 | A | 9/1991 | Snyder |
| 5,123,851 | A | 6/1992 | Young et al. |
| 5,148,135 | A | 9/1992 | Stein |
| 5,163,836 | A | 11/1992 | Young et al. |
| 5,262,754 | A | 11/1993 | Collins |
| 5,274,917 | A | 1/1994 | Corbett et al. |
| 5,373,109 | A | 12/1994 | Argyrakis et al. |
| 5,380,212 | A | 1/1995 | Smeenge |
| 5,411,409 | A | 5/1995 | Gray |
| 5,479,110 | A | 12/1995 | Crane et al. |
| 5,504,940 | A | 4/1996 | Hahs et al. |
| 5,509,821 | A | 4/1996 | Small |
| 5,675,302 | A | 10/1997 | Howard et al. |
| 5,701,233 | A | 12/1997 | Carson et al. |
| 5,795,162 | A | 8/1998 | Lambert |
| 5,857,865 | A | 1/1999 | Shimirak |
| 5,872,550 | A | 2/1999 | Quan et al. |
| 5,904,580 | A | 5/1999 | Kozel et al. |
| 5,906,511 | A | 5/1999 | Bozzer |
| 6,094,115 | A | 7/2000 | Nguyen et al. |
| 6,146,168 | A | 11/2000 | Ishii |
| 6,183,272 | B1 | 2/2001 | Muller |
| 6,217,382 | B1 | 4/2001 | Ziers |
| 6,241,532 | B1 | 6/2001 | Howell |
| 6,348,659 | B1 | 2/2002 | Crotzer et al. |
| 6,358,615 | B1 | 3/2002 | Imai |
| 6,380,485 | B1 | 4/2002 | Beaman |
| 6,515,499 | B1 | 2/2003 | Parrish et al. |
| 6,541,867 | B1 | 4/2003 | Fjelstad |
| 6,590,478 | B2 | 7/2003 | Pluymers |
| 6,685,487 | B2 | 2/2004 | Ward |
| 6,686,732 | B2 | 2/2004 | Parrish |
| 6,712,620 | B1 | 3/2004 | Li et al. |
| 6,716,062 | B1 | 4/2004 | Palinkas et al. |
| 6,717,079 | B2 | 4/2004 | Heller |
| 6,752,639 | B1 | 6/2004 | Kirkman et al. |
| 6,767,248 | B1 | 7/2004 | Hung |
| 6,822,162 | B1 | 11/2004 | Valentine et al. |
| 6,835,071 | B2 | 12/2004 | Pupkiewicz |
| 6,843,657 | B2 | 1/2005 | Driscoll et al. |
| 6,864,696 | B2 | 3/2005 | Logelin et al. |
| 6,939,175 | B2 | 9/2005 | Parrish et al. |
| 7,074,047 | B2 | 7/2006 | Tutt |
| 7,080,998 | B2 | 7/2006 | Hall et al. |
| 7,107,034 | B2 | 9/2006 | Davis |
| 7,249,953 | B2 | 7/2007 | Tutt |
| 7,404,718 | B2 | 7/2008 | Tutt et al. |
| 7,503,768 | B2 | 3/2009 | Tutt et al. |
| 2003/0199181 | A1 | 10/2003 | Chou et al. |
| 2005/0062492 | A1 | 3/2005 | Bearman et al. |

FOREIGN PATENT DOCUMENTS

| | | |
|---|---|---|
| EP | 0798802 | 10/1997 |
| EP | 0889678 | 1/1999 |
| EP | 1083355 | 1/2003 |
| WO | WO2005046005 | 5/2005 |
| WO | WO2006127521 | 11/2006 |

OTHER PUBLICATIONS

Eleven-Page International Search Report, Mailed Mar. 24, 2005.

Ivanov, SA and Peshlov, V, Vertical Transition with Elastomeric Connectors, Ivanov, S.A. and Peshlov, V.; 14th International Conference on Microwaves, Radar and Wireless Communications. MIKON-2002. vol. 2, May 20-22, 2002, pp. 472-475.

Maurer, DJ, Elastomeric Connectors in a New Role, Sensors, vol. 15, No. 2, 1998, pp. 55-57.

Three-page International Search Report, Mailed Sep. 22, 2006.

HIGH FREQUENCY CONNECTOR ASSEMBLY

RELATED APPLICATIONS

This application is a Continuation Application of U.S. patent application Ser. No. 11/669,703 filed Jan. 31, 2007 and entitled "High Frequency Connector Assembly"; which application itself is a Continuation-In-Part application of U.S. Pat. No. 7,404,718, issued Jul. 29, 2008, entitled "High Frequency Connector Assembly"; which application itself is a Continuation-In-Part of U.S. Pat. No. 7,074,047, issued Jul. 11, 2006, and entitled "Zero Insertion Force High Frequency Connector," which application and patents are incorporated herein by reference in their entireties.

BACKGROUND OF THE INVENTION

This present invention relates generally to electrical connectors, and particularly to improving the performance, construction and ease of use of high frequency electrical connectors.

BACKGROUND OF THE INVENTION

The use of electronic products of all kinds has increased dramatically throughout society, which has led to a significant increase in the demand for improved components utilized within such products. One facet in the utilization of such electronic products involves the coupling of high frequency signals, e.g., data and/or communications signals, between various signal-bearing components, such as electronic circuit boards.

Some electronic products include a rack or frame into which multiple circuit packs are inserted. Generally, a frame includes a circuit board referred to as a "backplane", while a circuit pack may include one or more circuit boards. A backplane generally includes multiple connectors soldered to and interconnected by conductive traces. A backplane typically provides little functionality other than electrically interconnecting the circuit boards within the circuit packs. A backplane however may also provide electrical connections external to the frame. When a backplane includes functionality, it may be referred to as a "motherboard". Such is the case, for example, in a personal computer (PC).

Since back planes are sometimes referred to as motherboards, the circuit packs containing circuit boards that are electrically interconnected using such a motherboard backplane are often referred to as daughter cards. Each daughter card includes one or more circuit boards having electrically conductive traces to electrically interconnect various electrical components in a circuit. Electrical components, such as integrated circuits (ICs), transistors, diodes, capacitors, inductors, resistors, etc., may be packaged with metallic leads that are soldered to conductive traces on a daughter card. A daughter card will typically include a connector, proximate an edge, and soldered to the traces, for electrically coupling to a corresponding connector on the motherboard backplane when inserted into the frame.

One common method of attaching electrical components to a circuit board is to include "through holes", e.g., holes drilled through the circuit board, and land areas in the traces proximate the holes. Wire leads on the electrical components may then be bent or "formed" or configured for insertion through the holes, and soldered to the land areas once inserted, or "placed."

Readily available through hole male and female connectors, such as GbXJ, VHDM-HSDJ, VHDM7, Hardmetric (HM), CompactPCI, etc. from manufacturers such as Amphenol, Teradyne, Tyco, etc. are often used for interconnecting two circuit boards. Such connectors are available in various sizes, having various arrays of conductive contact pins. Such arrays of pins are generally held together using a dielectric material, forming the connector. Each pin includes a portion extending from the dielectric material that may be inserted into a through hole in a circuit board. A circuit board for use with a respective connector will have through holes corresponding to the pins of the connector. Conductive traces on the circuit board extend from the land areas corresponding to the pins forming nodes in a circuit.

In production, a circuit board is often placed on a conveyer. As the conveyer moves the board, a solder paste is applied to the board. Through hole electronic components, including connectors, are typically hand placed in the corresponding through holes, the solder paste having been applied. The conveyer then carries the board and connector through an oven that heats the solder paste, soldering the connector to the board. Such a process is generally referred to as "wave soldering".

Another common method of attaching electrical components to a circuit board is referred to as "surface mounting." In surface mounting, land areas are also included in the traces, but holes through the circuit board are not necessary. In the case of a surface mount connector, rather than each pin including a portion that may be inserted into a through hole in a circuit board, each pin will include an electrically conductive "foot". A surface mount connector with conductive feet may be slid over and/or bolted to the edge of a circuit board, the feet corresponding to land areas in the traces on the circuit board. Likewise, in production, surface mount connectors may also be wave soldered.

Irrespective of whether one of these connectors is a through hole or surface mount type, each type suffers from common problems once attached to a circuit board. For example, the pins typically found in these connectors are quite fine, or small. Any deviation in alignment when plugging one connector into another can result in the bending of one or more of these pins. This generally causes either a failure of the product under production test, or worse, a failure of the product in the possession of a user or consumer.

When a pin of a connector is bent, the connector must be removed from the board and a new connector installed. This is can be a time-consuming and difficult process. In the case of a surface mount connector, each of the conductive feet must heated one at a time and bent away from its respective land area to remove the connector. Alternatively, all of the conductive feet must be heated simultaneously to re-flow the solder, allowing the connector to be removed from the board. Typically, a hot air gun is used for such heating. This subjects the board, as well other components adjacent to the connector, to a substantial amount of heat. A heat gun in the hands of an inexperienced repair technician can result in the board being ruined, or the adjacent components being damaged. Even when a heat gun is not used, replacement of a surface mount connector can take a considerable amount of time, and still requires a skilled technician.

In the case of a through hole connector, a heat gun also generally must be used. Through hole connectors typically require even more heat to be applied to a board for removal than surface mount connectors. Again, this makes removal difficult, increasing the chances for an unskilled technician to damage the board or surrounding components. In some cases, with connectors having a large array of pins, it becomes impractical, if not impossible, to simultaneously re-flow the solder on every pin. In such cases, the board must be scrapped.

Another problem inherent in prior art connectors is that the geometric arrangement and/or spacing between pins is not maintained through the connector to the surface of a respective circuit board. For example, pins in such connectors are generally used in pairs, a pair of pins carrying either a single ended or differential data and/or communications signal. Deviation in the geometric arrangement and/or spacing of between pins when used as a pair generally results in impedance variation with a change in frequency, thereby degrading the electrical performance of the connector and/or limiting the usable frequency range of the connector. Further, since these pins are arranged in an array, and pairs of pins are generally in close proximity to other pairs of pins, there can be, and often is electromagnetic interaction between pairs and/or pins. Such interaction is typically referred to as "crosstalk". Ideally, these pins would be consistently spaced throughout, and the connectors would provide some sort of shielding of the pairs to prevent crosstalk. Such connectors provide no shielding, nor is consistent spacing possible. Therefore, there is a need in the prior art to improve upon the connectivity between circuit board and respective motherboards. There is specifically a need to address the problems with such connectors when used with boards handling high-speed data and other communications signals.

One type of connectors used for electrically coupling an electrical component to a circuit board is an elastomeric connector. Generally, an elastomeric connector comprises a body constructed of an elastic polymer material having opposing first and second faces and a plurality of fine conductors that are passed from the first to the second faces. An elastomeric connector may be positioned between land areas on a circuit board and conductive leads on the component, aligning the leads with the land areas. Pressure is then applied to the connector to compress the elastic polymer, providing electrical connection from the land areas on a circuit board on one face through the conductors to leads of the component on the other face. One example of the use of such an elastomeric connector is in electrically coupling a liquid crystal display (LCD) screen to a circuit board in a calculator. However, signals between an LCD screen and a circuit board are low frequency digital signals not high frequency data/communications signals. Therefore, there is little concern for the geometric arrangement of the components or shielding. Thus, elastomeric connectors are essentially often just parallel data and/or power lines.

There have been other uses of elastomeric materials, such as in test fixtures to electrically contact integrated circuit chips in production testing, to couple a ribbon cable to a circuit board, or in coupling a pin grid array to a circuit board. However, again the elastomeric connectors when so used are generally parallel data and/or power lines. Yet another use of an elastomeric material has been in the form of a seal in a connector to thereby extend the shielding provided by an outer conductor in a data cable. Therefore, elastomeric connectors, to date, are essentially for power transfer or simple low frequency digital signal transfer or shielding. Therefore, such connectors have not been particularly suited to the transfer of high frequency signals, e.g., data and/or communications signals in a connector assembly between two circuit boards.

It is desirable to address drawbacks in the prior art in providing high frequency RF data and/or communications connections between electrical circuit boards.

Furthermore, it is desirable to maintain the geometric arrangement and alignment of conductors in a connector.

Additionally, it is desirable to improve the replacement and serviceability of a high-speed data connector assembly.

It is further desirable to provide multiple such connections in a compact arrangement, such as an array, that are shielded.

It is further desirable to provide RF data connections, in addition to other connections, and signal formats in a single connector assembly.

These objectives and other objectives will become more readily apparent from the summary of invention and detailed description of embodiments of the invention set forth herein below.

SUMMARY OF THE INVENTION

The present invention addresses the above drawbacks and provides the benefits of an elastomeric connector, while providing high frequency data and/or communications connections between two electrical circuit boards or other components. To this end, and in accordance with principles of the present invention, a connector assembly includes a signal array including a plurality of conductors having inner and outer conductive elements. The inner and outer conductive elements of the array are presented proximate a surface of a connector body in a generally co-planar arrangement, and the conductive elements terminate in a face surface that is raised above the front surface of the connector body. A compressible interface element with two faces and a plurality of conductive elements extending from face to face is coupled between the array and another signal-bearing component, such as another similar array or a circuit board. The compressible interface element is compressed between the array and signal-bearing component to pass a high-speed data and/or RF communication signal from the array to the signal-bearing component.

The connector assembly of the invention maintains the geometric arrangement of the inner and outer conductive elements of the array through the connector. The connector assembly is also easily replaced requiring no soldering and is, therefore, easily and readily serviceable.

In one embodiment of the invention, conductive elements to handle additional signals or signal formats, such as DC signals or fiber optic signals, are incorporated into a connector body with the RF signal array.

These features and other features of the invention will be come more readily apparent from the Detailed Description and drawings of the application.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
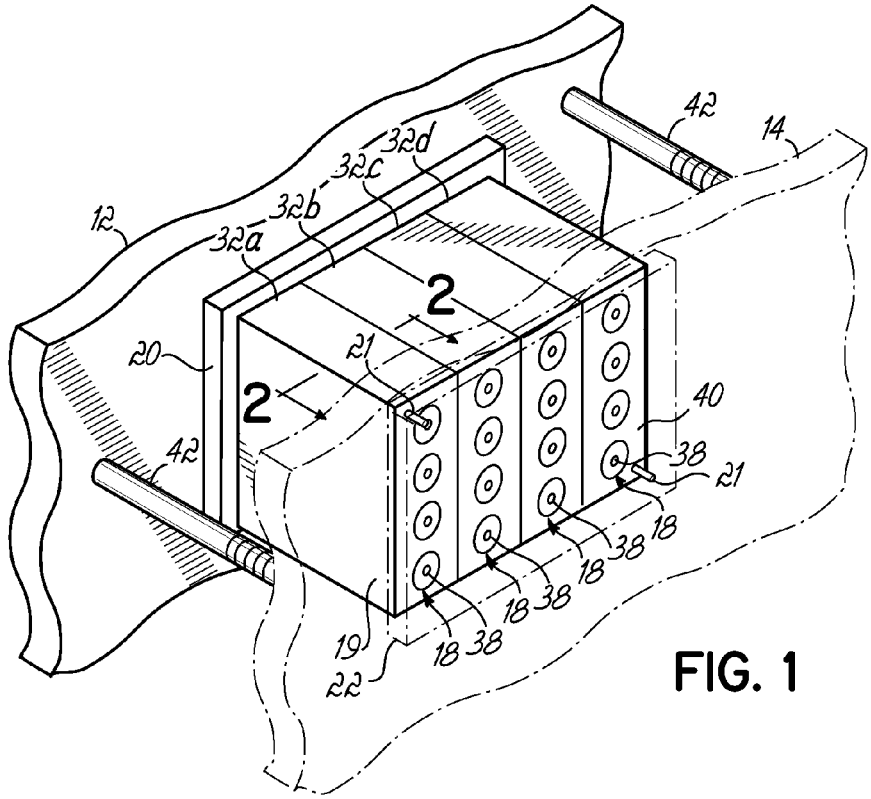
FIG. 1 is a perspective view of an embodiment of a connector assembly between two substantially parallel signal-bearing components, such as circuit boards.
Figure 2:
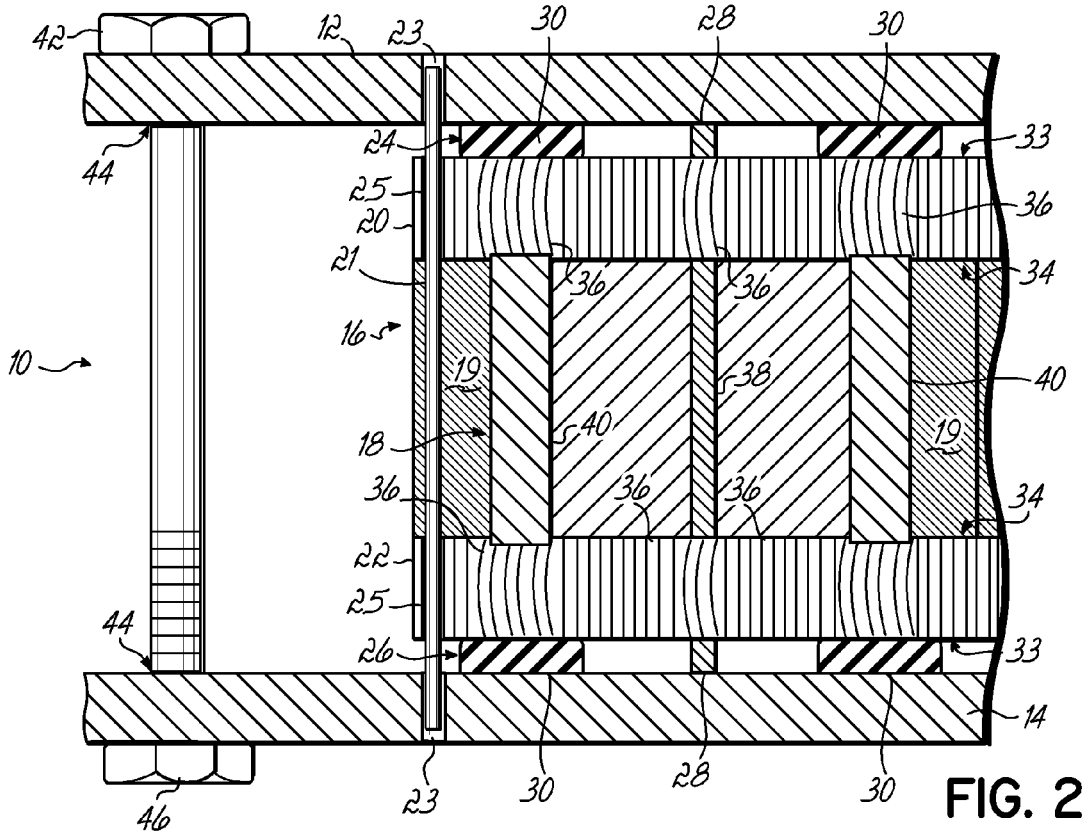
FIG. 2 is a partial cross-sectional view of the connector assembly of FIG. 1 along line 2-2 of FIG. 1.

Referring to FIGS. 1 and 2, connector assembly 10 comprises two substantially parallel oriented signal-bearing components, such as circuit boards 12, 14 (circuit board 14 shown in phantom line), a signal array 16 including at least one shielded conductor 18, and compressible interface elements 20, 22 (compressible interface element 22 also shown in phantom line) coupled between each circuit board 12, 14 and shielded conductor 18. Circuit boards 12, 14 include corresponding shielded land areas 24, 26, only shielded land area 26 being shown in FIG. 1. Shielded conductor 18 has opposite ends and includes an axial conductive element 38 and an outer conductive element 40 surrounding the axial conductive element 38. Shielded land areas 24, 26 include a central conductive core area 28 and a conductive outer structure area 30. Land areas 24, 26 on circuit boards 12, 14 may be etched, deposited, or other placed using methods well known to those of skill in the art.

Although not shown for ease of illustration, those of skill in the art will appreciate that central conductive core areas 28 and conductive outer structure areas 30 extend to traces on multiple layers of circuit boards 12, 14, and, in some instances, to electrical components, e.g., integrated circuits (ICs), transistors, diodes, capacitors, inductors, resistors, etc., soldered to those traces. Such traces, in part, form nodes in circuits on circuit boards 12, 14. The construction of and uses for circuit boards including traces on multiple layers are well known to those of skill in the art.

For example, signal-bearing components or circuit boards 12, 14 may be a backplane and a circuit pack. Circuit boards 12, 14 may be two circuit boards comprising a circuit pack. Circuit boards 12, 14 may also be a motherboard and a daughter card. Other applications wherein two substantially parallel circuit boards are desired will readily appear to those of skill in the art.

Again, a signal array, such as signal array 16, comprises one or more blocks or wafers 32, each including one or more shielded conductors 18. Each shielded conductor 18 includes an axial conductive element 38 and an outer conductive element 40 surrounding the axial conductive element 38, as may be seen in FIG. 2.

Shielded conductors are generally used for high-speed or high frequency signals, such as high-speed data and/or communications signals. Signals as defined herein mean essentially conducted voltages and/or currents associated with conductors and not necessarily "smart" signals. Further, the simultaneous conduction of voltages and/or currents create a data signal or other signal.

Desirable attributes of shielded conductors worthy of particular note are minimizing interference and constant impedance. For example, the outer conductive element or shield of a shielded conductor is generally connected to a voltage reference or electrically grounded. Thus, other shielded conductors likewise having grounded shields will generally be resistant to interference by the signals carried by the adjacent shielded conductors. Such coupling or interfering of signals between proximate conductors may also be referred to as "crosstalk". The lack of "crosstalk" between shielded conductors is generally due to there being no voltage gradient between the various shields due to each of the shields being grounded or connected to the same or similar reference or voltage potential.

Further, shielded conductors are commonly available in two types, though others may be possible. One type is coaxial, or coax, and another type twinaxial, or twinax. Coaxial conductors generally have a central or inner conductive core or center conductor equally spaced or centered axially within a shield or outer conductive structure. An outer conductive structure may be braided wires or a conductive foil, or some combination thereof, or some rigid or semi-rigid adequately conductive metal.

Similarly, twin axial conductors generally have two central conductive cores or center conductors spaced apart or twisted and equally spaced or centered axially, within a shield or outer conductive structure. Thus, both types have an axial conductive element and an outer conductive structure surrounding the axial conductive element, an axial conductive element being defined herein as a conductive element located or spaced axially within an outer conductive element.

In use, the center or inner conductor of a coaxial conductor generally carries a signal that varies with respect to the shield, which is generally electrically grounded as mentioned above. Such a signal may be referred to "single-ended," in that only the center conductor carries a signal that varies with respect to ground. In contrast, a twinaxial conductor has two center conductors that carry signals that are the same, but 180 degrees out of phase. The advantage in a twinaxial conductor is that any interference that is induced or coupled into the center conductors of the twinaxial conductor past the shield may be cancelled when the two out of phase signals are added together. Thus, the signal is formed by the difference between the two out of phase signals carried by the center conductors, such a signal being referred to "differential."

If the signals carried by the signal array are low speed or low frequency, the spacing between the center conductors and the shield of the array elements is of little consequence as is the way in which the array is coupled to another signal-bearing component. However, as the speed or frequency of the signals carried by center conductors is increased, the spacing between the center conductors and the shield becomes significant and any misalignments or other problems in the way in which the signal array couples with another signal-bearing components causes signal degradation and possible signal errors, particularly in high frequency data signals. For example, with high-speed data and/or communications signals, the spacing between the center conductors and the shield, along with the center conductors and the shield themselves, form a capacitor of significant value. Such capacitance in a shielded conductor is often referred as a "distributed capacitance," as the capacitance is distributed along the length of the conductor, and may be described in units of picofarads per foot (pF/ft).

Moreover, the overall size or dimensions of a shielded conductor, along with the spacing, determines a characteristic impedance for the conductor at particular frequency ranges of use. For example, common impedances for coaxial and twinaxial cables are 50, 75, 100, and 110 ohms. Such characteristic impedances are of particular importance in designing a high frequency circuit for maximum power transfer between a source and a load.

The present invention addresses both interference and constant impedance, as well as other things, in providing connectors and/or connector assemblies for use with high-speed data and/or communications signals and related signal-bearing components.

For example, and as shown in FIG. 1, signal array 16 includes four blocks 32, each containing four shielded conductors 18, that are used to form a four-by-four array. The conductors 18 are in the form of generally embedded cables, embedded in the blocks 32. Those skilled in the art will appreciate that any number of blocks having any number of shielded conductors may be used to form an array of any size desired, and that a variation in the size of an array does not constitute a departure form the spirit of the present invention. Signal array 16 will be discussed in more detail in conjunction with FIG. 3.

Referring now to FIG. 2, a partial cross-sectional view of connector assembly 10 taken along line 2-2 of FIG. 1 is shown. Generally, FIG. 2 shows a cross-sectional view through one of the shielded conductors 18 or cables in signal array 16, along with the coupling of that conductor to the circuit boards 12, 14. Again, each shielded conductor 18 includes an axial conductive element 38 and an outer conductive element 40. Each shielded conductor or cable 18 of the embodiments in FIGS. 1-9 is molded, potted or otherwise embedded in a nonconductive substance, such as a liquid crystal polymer (LCP) material 19. Molding the shielded conductors 18 into LCP material 19 allows positioning of the ends of the conductor to tight tolerances typically found with such molding. Additional details concerning such molding will be discussed herein after. Those skilled in the art will appreciate that the expansion of the cross-sectional view to include other conductors in the array would be redundant in nature; and therefore, such an expansion is not made for ease of illustration and purposes of clarity.

Compressible interface elements 20, 22 are used between the array 16 and other signal-bearing components and each include two faces 33, 34 and conductive elements 36 (not shown in FIG. 1; but, shown in FIG. 2) extending from face 32 to face 34. Compressible interface elements 20, 22 are generally constructed of an elastomeric material, e.g., elastomeric connectors. The elastomeric connectors comprises a body constructed of an elastic polymer having opposing first and second faces, e.g., faces 33 and 34 shown in FIG. 2, and a plurality of fine conductors, e.g., conductive elements 36, also shown in FIG. 2, that pass or extend from the first to the second faces.

Elastomeric connectors may be constructed using extremely accurate silicon rubber with anisotropic conductive properties. Such connectors may include anywhere from 300 to 2,000 fine metal wires per square centimeter embedded in the thickness direction of a transparent silicone rubber sheet. Such fine metal wires are generally gold-plated to ensure low resistivity and the ability to withstand relatively high current flow.

In use, compressible interface elements 20, 22 are placed between corresponding shielded land areas 24, 26 on circuit boards 12, 14 and shielded conductors 18 in signal array 16, aligning the central conductive core areas 28 and the conductive outer structure areas 30 with the axial or conductive element 38 and the outer conductive element 40 of the shielded conductors or cables 18, respectively. Guide pins or posts 21 also molded into LCP material 19, corresponding to holes 23 in circuit boards 12, 14 and holes 25 in compressible interface elements 20, 22 are configured to aid in, or provide, such alignment. Those of ordinary skill in the art will appreciate that other structures such as notches, raise portions or bumps and corresponding recessed portions, etc. may be used in the alternative to aid in or provide alignment.

Pressure is then applied to compressible interface elements 20, 22 to compress the elements 20, 22 such that the conductive elements 36 provide electrical connection from shielded land areas 24, 26 on circuit boards 12, 14 on faces 32 through elements 36 to shielded conductor 18 on faces 34. In that way, signals are passed between the signal array and the signal-bearing component while maintaining geometric arrangement of the inner and outer conductive elements of cables 18 of array 16 and conductive elements of the signal-bearing component, such as a circuit board. Such pressure or compression typically causes those conductive elements making such contacts to distort or bend as shown, whereas those conductive elements that do not make such contacts generally remain straight.

It will be appreciated that holes 25 in compressible interface elements 20, 22 are not necessary for alignment of compressible interface elements 20, 22. To function adequately, compressible interface elements 20, 22 only need cover shielded land areas 24, 26 and the ends of shielded conductors 18, as aligned. Which conductive elements 36 within compressible interface elements 20, 22 make contact with or electrically couple the shielded land areas 24, 26 and the ends of shielded conductors 18 is irrelevant. Rather, holes 25 in compressible interface elements 20, 22 merely serve to hold compressible interface elements 20, 22 in place as connector assembly 10 is assembled.

However, proper alignment of corresponding shielded land areas 24, 26 on circuit boards 12, 14 and shielded conductors 18 in signal array 16, is necessary to electrically couple the circuit boards. Moreover, and with respect to each shielded conductor 18, the compressible interface elements 20, 22, when compressed between the signal array 16 and a signal bearing component, such as circuit boards 12, 14, maintains the geometric arrangement of the axial conductive element 38 and the outer conductive element 40 through the compressible interface elements 20, 22 to the signal bearing component, or circuit boards 12, 14. Further, those conductive elements 36 under pressure and contacting the central conductive core areas 28 and the conductive outer structure areas 30 with the axial conductive element 38 and the outer conductive element 40, respectively, form, in effect, a solid center conductor and a solid surrounding outer shield due to the density of the conductive elements 36 in compressible interface elements 20, 22. That is, there is effectively a 360° shield formed around the center conductor of each cable. Still further, when compressible interface elements 20, 22 are compressed, the shielding of each shielded conductor 18 is extended, and in effect, the compressible interface connectors take on the shielding arrangement of the shielded conductors 18 in blocks 32*a-d*.

Pressure may be applied using a variety of fasteners. For example, and as shown in FIG. 1, bolts 42 extending through corresponding holes 44 in circuit boards 12, 14 with nuts 46 may be used to compress, or apply pressure to, compressible interface elements 20, 22 coupled between circuit boards 12, 14 and signal array 16. Other fasteners including, but not limited to, bolts, screws, threaded inserts, tapped portions, etc. may used in the alternative.

Figure 3:
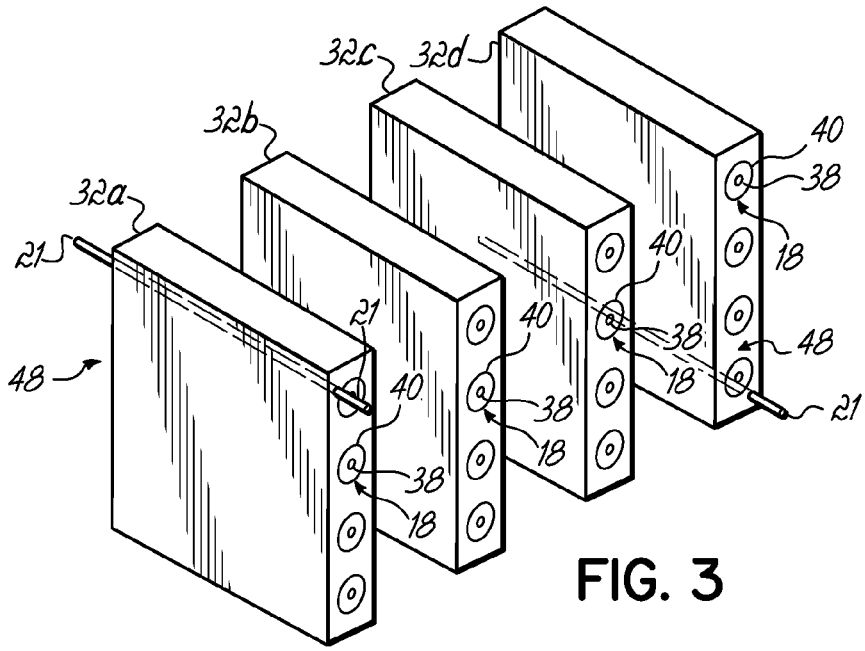
FIG. 3 is an exploded view of the signal array shown in FIGS. 1 and 2.

Referring now to FIG. 3, an exploded view of signal array 16 shown in FIGS. 1 and 2 is illustrated. Signal array 16 of the illustrated embodiment comprises four blocks 32*a-d*, each including four shielded conductors or embedded cables 18. A greater or lesser number of blocks or a greater or lesser number of shielded conductors 18 per block might also be used. Each shielded conductor 18 includes an axial or inner conductive element 38 and an outer conductive element 40. For example, shielded conductors 18 may be semi-rigid coax or flexible cables or other known to those of skill in the art.

Each block 32*a-d* may be constructed by molding, potting or otherwise embedding shielded conductors or cables 18, such as, for example, lengths of semi-rigid coax, in a non-conductive substance, such as a LCP material 19, as mentioned above. The contact faces or face surfaces 48 of the blocks 32*a-d* may then be machined or polished to improve the co-planarity of the shielded conductors 18 or semi-rigid coax on a contact faces or face surfaces 48. Such machining or polishing improves the interface between signal array 16 and compressible interface elements 20, 22. The inner conductive elements 38 and outer conductive elements 40 of the cables 18 are presented at the face surfaces 48. Guide pins or posts 21 may likewise be molded into one or more blocks 38*a-d*. For example, and as shown in FIG. 3, guideposts 21 are molded into blocks 38*a* and 38*d*.

The array 16 of shielded conductors 18 in combination with compressible interface elements 20, 22 that extends the shielding of the shielded conductors 18 may be used for single-ended signals, such as high-speed data and/or communications signals in one aspect of the invention. Shielding is particularly useful in preventing interference when using such high-speed signals. Moreover, shielding prevents "crosstalk" between shielded conductors placed in close proximity with one another, and facilitates the construction of dense or tightly spaced arrays of shielded conductors. The present invention provides a connection between a signal array and another signal-bearing component and maintains the desired signal integrity at the connection.

In addition, connector assembly 10 includes elastometic connector elements, e.g., compressible interface elements 20, 22, in providing high frequency data and/or communications connections between circuit boards 12 and 14. In doing so, connector assembly 10 requires no soldering. Further, no soldering or special skill is required repair the connection, such as to remove and replace one of the compressible interface element 20, 22 or the signal array 16. A user need only remove the fasteners 42, 46, reposition new compressible interface elements, and/or a new signal array, and, with the aid of guide posts 21, reinstall the fasteners 42, 44. Moreover, connector assembly 10 includes no pins that may be bent or broken in assembly, resulting in degradation of the signal or failure of the connection.

Furthermore, connector assembly 10 extends the geometric arrangement of the shielded conductors 18 in the signal array 16 through the connector assembly 10 to the surface of the signal-bearing component, such as circuit boards 12, 14. By extending the geometric arrangement, with its inherent shielding, through the connector assembly, the signal integrity is maintained, crosstalk between shielded conductors in the array is reduced, while the variation in impedance with changes in frequency of each respective shielded conductor 18 is also reduced. Thus, connector assembly 10 improves the replacement and serviceability of high-speed data and/or communications connections and interfaces.

Figure 4:
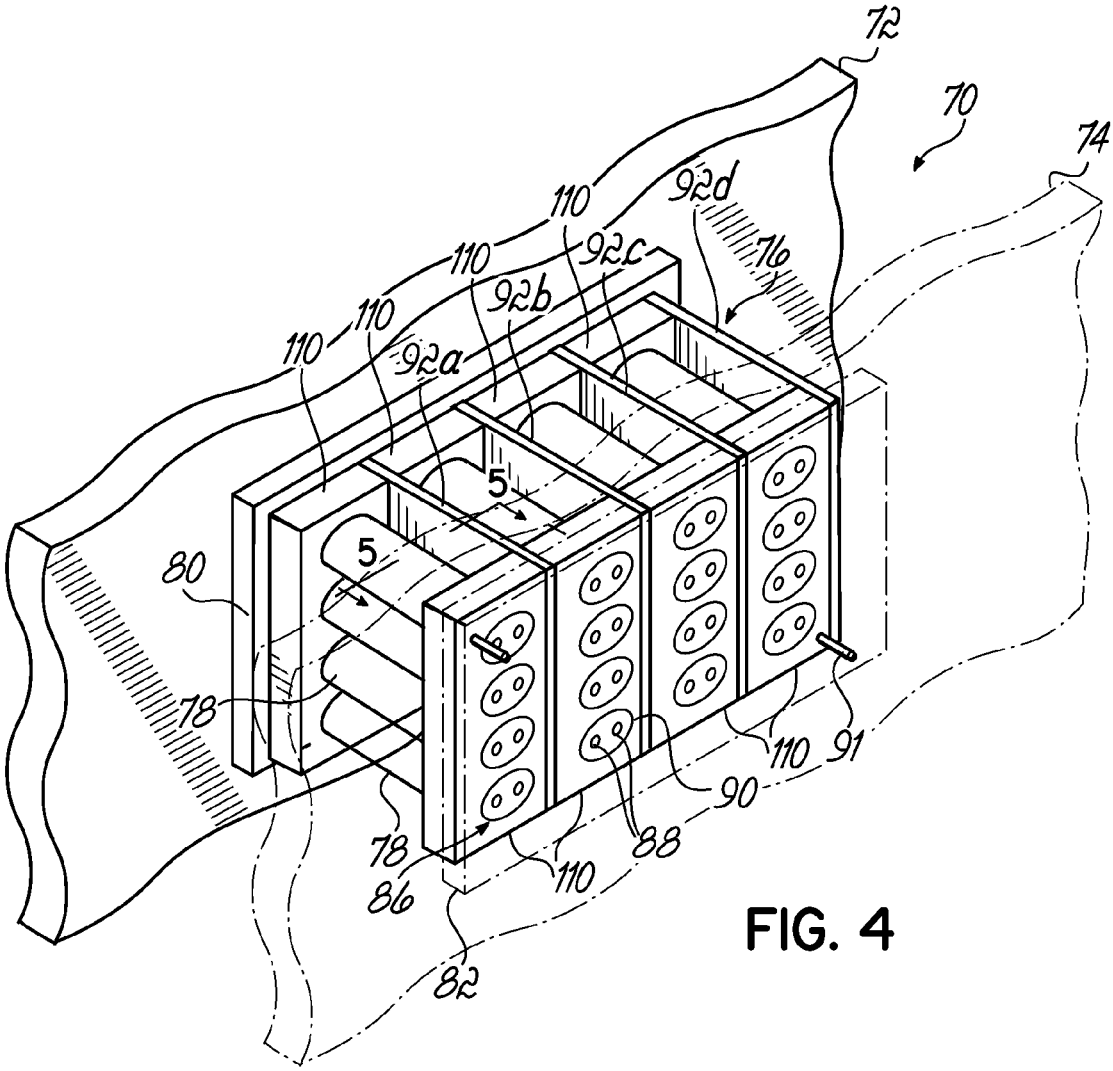
FIG. 4 is a perspective view of an embodiment of a connector assembly between two substantially parallel circuit boards having twinaxial land areas.
Figure 5:
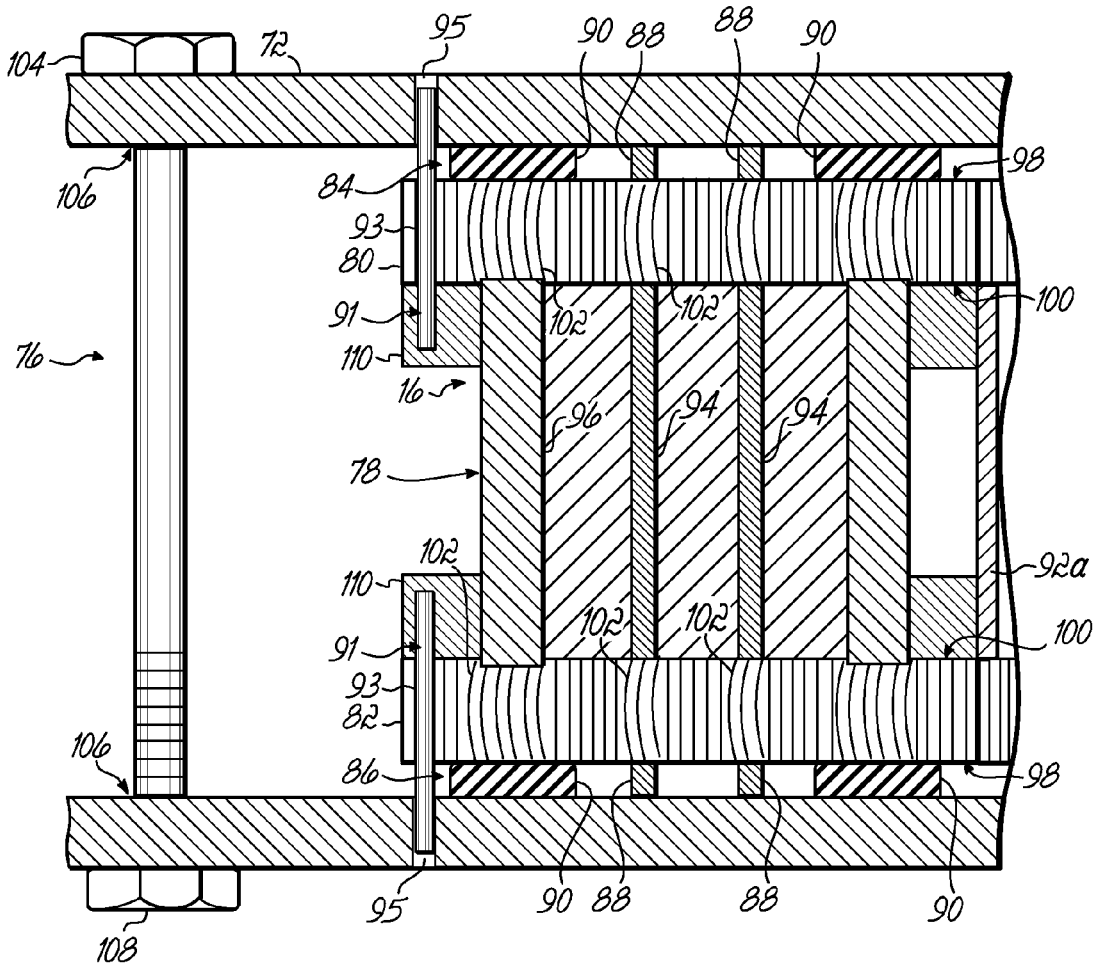
FIG. 5 is a partial cross-sectional view of the connector assembly of FIG. 4 along line 5-5 of FIG. 4.

The invention is also useful in a twinaxial arrangement, having two inner conductive elements. Referring now to FIGS. 4 and 5, connector assembly 70 comprises two substantially parallel circuit boards 72, 74 (circuit board 74 shown in phantom line), a signal array 76 including at least one shielded conductor or cable 78, and compressible interface elements 80, 82 (element 82 also shown in phantom line) coupled between each circuit board 72, 74 and shielded conductor 78. Circuit boards 72, 74 include at least one pair of corresponding shielded land areas 84, 86, only shielded land area 86 being shown in FIG. 4. Shielded land areas 84, 86 include two central conductive core areas 88 and a conductive outer structure area 90.

Although not shown, those of skill in the art will appreciate that central conductive core areas 88 and conductive outer structure areas 90 extend to traces on multiple layers of circuit boards 72, 74. Such traces form nodes in circuits on circuit boards 72, 74, the construction of and uses for circuit boards including traces on multiple layers being well known to those of skill in the art. For example, circuit boards 72, 74 may be a backplane and a circuit pack, two circuit boards comprising a circuit pack, or a motherboard and a daughter card. Other applications of two such circuit boards will readily appear to those of skill in the art.

Signal array 76, comprises four (or more or less) wafers 92*a-d*, each containing four (or more or less) shielded conductors 78. Each shielded conductor 78 includes two axial or inner conductive elements 94 and a conductive outer element 96, as may be seen in FIG. 5. Signal array 76 will be discussed in more detail in conjunction with FIG. 6.

Referring now to FIG. 5, a partial cross-sectional view of connector assembly 70 taken along line 5-5 of FIG. 4 is shown. More specifically, FIG. 5 shows a cross-sectional view through one of the shielded conductors 78 in wafer 92*a* in signal array 76, along with the coupling of the shielded conductor 78 to circuit boards 72, 74.

Compressible interface elements 80, 82 each include two faces 98, 100 and conductive elements 102 that extend from face 98 to face 100, and are constructed of an elastomeric material. Thus, compressible interface elements 80, 82 may be referred to as elastomeric connectors and may be similar to those previously described above as elements 20, 22.

Compressible interface elements 80, 82 are placed between corresponding shielded land areas 84, 86 on circuit boards 72, 74 and shielded conductors 86 in signal array 76, aligning the central conductive core areas 88 and the conductive outer structure areas 90 with the two axial conductive elements 94 and the conductive outer element 96, respectively. For example, FIG. 5 shows such an alignment. Guide posts 91 molded into mounting ends 110 and extending through holes 93 in compressible interface elements 80, 82 and holes 95 in circuit boards 72, 74 aid in such alignment while holding compressible interface elements 80, 82 in position during assembly of connector assembly 70.

Pressure is applied to compressible interface elements 80,82 such that conductive elements 102 provide electrical connections from shielded land areas 84, 86 on circuit boards 72, 74 on faces 98 through elements 102 to shielded conductors 78 on faces 100. Such pressure causes those conductive elements making such contacts to distort or bend slightly as illustrated. Pressure may be applied using bolts 104 extending through corresponding holes 106 in circuit boards 72, 74 with nuts 108, as shown. Such bolts 104 may also aid in alignment in some embodiments. Other fasteners may be used in the alternative without departing from the spirit of the present invention.

When compressible interface elements 80, 82 are compressed as illustrated, conductive elements 102 contacting conductive outer element 96 and conductive outer structure areas 90 form generally a 360° shield around, or "shield", those conductive elements 102 contacting axial conductive elements 94 and central conductive core areas 88. Thus, under pressure, conductive elements 102 of compressible interface elements 80,82 "extend" the geometric arrangement or shielding of shielded conductors 78 through to land areas 84, 86, or the surface, of circuit boards 72, 74.

Figure 6:
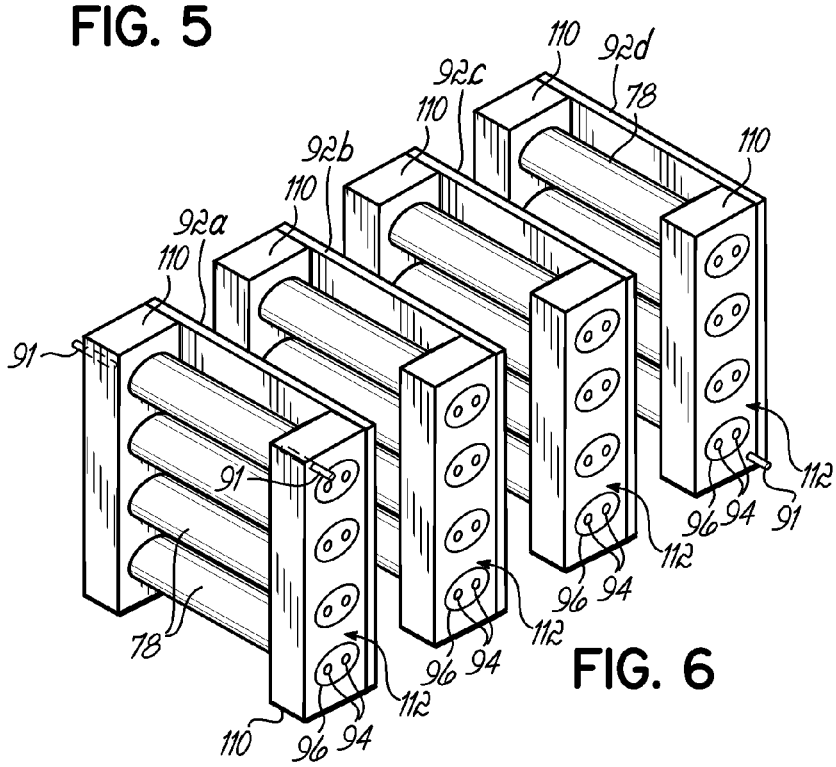
FIG. 6 is an exploded view of the signal array shown in FIGS. 4 and 5.

Referring now to FIG. 6, an exploded view of signal array 76 shown in FIGS. 4 and 5 is illustrated. Signal array 76 comprises four (or more or less) wafers 92*a-d*. Each wafer 92*a-d* comprises four (or more or less) twinaxial conductors 78 and two mounting ends 110. Each twinaxial conductor includes two central or inner conductive cores 94 and a conductive outer element 96.

Each wafer 92*a-d* may be constructed using circuit board materials well know to those of skill in the art, such as fiberglass, epoxy, Teflon, etc. Coupled to each wafer 92*a-d* are mounting ends 110. Mounting ends 110 may be constructed of a non-conductive substance, such as a LCP, and molded or formed to receive shielded conductors 78. Shielded conductors 78 may be lengths of semi-rigid twinax cables well known to those of ordinary skill in the art. The contact faces or face surfaces 112 of mounting ends 110 and shielded conductors 78 may be machined or polished to improve the co-planarity of the shielded 78 on the contact faces 112. Such machining improves the interface between signal array 76 and compressible interface elements 80, 82. The inner 94 and outer 96 conductive elements of the conductors 78 are presented at the face surface in a generally co-planar arrangement for presenting the signal array to a signal-bearing component such as the circuit boards 72, 74. Unlike array 16, the conductors 78 are not completely embedded in molded material such as LCP.

Shielded conductors 78 accompanied by compressible interface elements 80, 82 that extend the shielding of the shielded conductors may be used for differential signals, such high-speed data and/or communications signals. Shielding is particularly useful in preventing interference when using such high-speed signals, while two axial conductive elements conducting a differential signal is useful in canceling any noise or interference that penetrates the shielding. Moreover, shielding prevents "crosstalk" between shielded conductors placed in close proximity with one another, and facilities the construction of tightly spaced arrays. The interface elements 80, 82 pass the signals between the array 76 and boards 72, 74 while maintaining the integrity of the shielded geometric arrangement of the conductive elements through the connection interface.

Connector assembly 70 also capitalizes on the benefits of elastomeric connectors, e.g., compressible interface elements 80, 82, in providing high frequency data and/or communications connections between circuit boards 72, 74. In doing so, connector assembly 70 requires no soldering. Also, no soldering or special skill is required to remove and replace one of the compressible interface elements 80, 82 or signal array 76. A user need only remove the fasteners, reposition the new interface elements and/or signal array, and reinstall the fasteners. Connector assembly 70 also improves the replacement and serviceability of high-speed data and/or communications connections. There are also no pins to bend or break in the connector, and "crosstalk" qualities are improved at the connector assembly.

Figure 7:
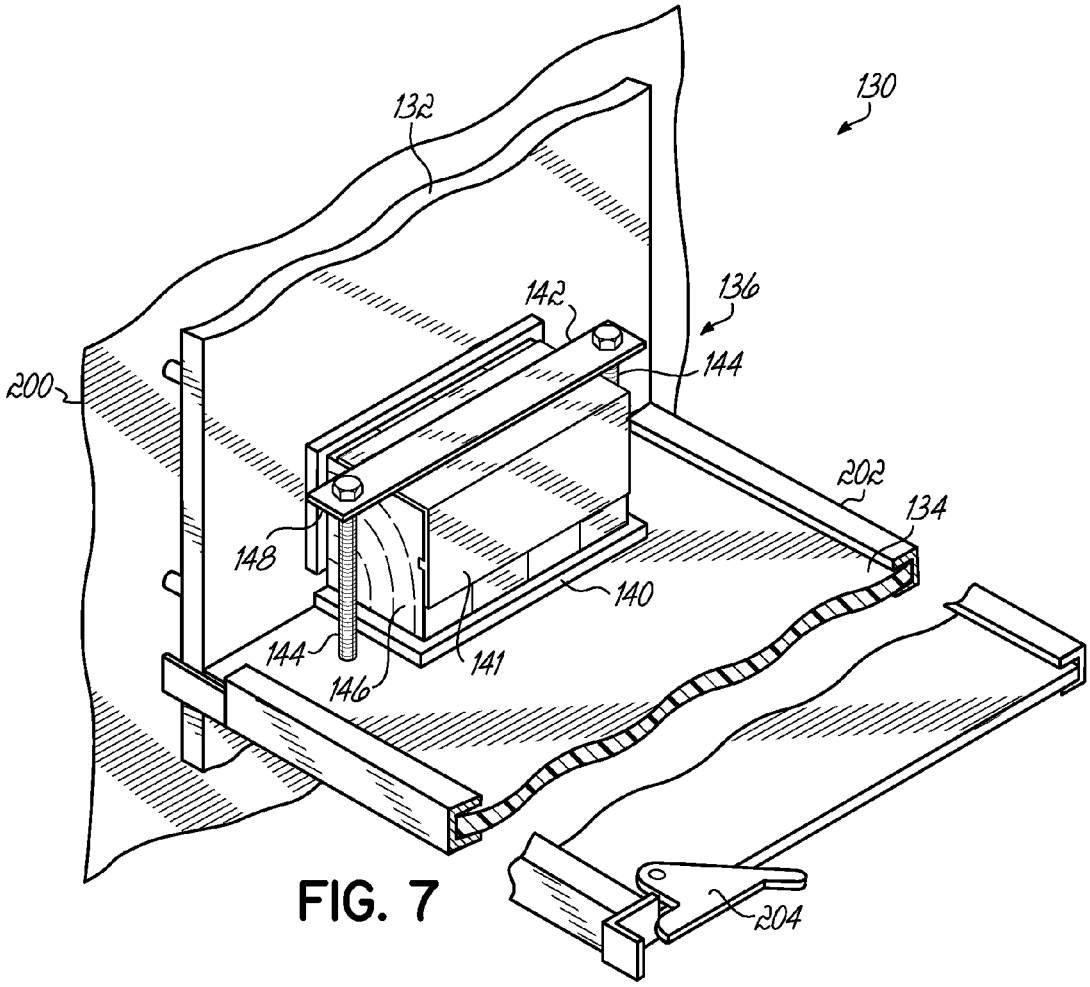
FIG. 7 is perspective view of an embodiment of a connector assembly between two substantially orthogonal circuit boards in accordance with principles of the present invention.

Referring now to FIG. 7, a perspective view of connector assembly 130 between two substantially orthogonal signal-bearing components, such as circuit boards 132, 134 is shown. Connector assembly 130 comprises two substantially orthogonal circuit boards 132, 134, a signal array 136 including at least one shielded conductor 146 (shown in phantom line), and compressible interface elements 138, 140 coupled between each circuit board 132, 134 and shielded conductor 146. Compressible interface elements 138, 140 may be elastomeric connectors, as generally described herein above, and more specifically described in conjunction with FIGS. 2 and 5.

Shielded conductor 146 may, for example, be lengths of semi-rigid coax or twinax cables, including one or two inner or axial conductive elements, respectively, and a conductive outer structure. Examples of signal arrays including shielded conductors with one and two axial conductive elements will be described in FIGS. 8 and 9, respectively. Those skilled in the art will appreciate that shielded conductors containing more than two axial conductive elements may also used for high-speed data and/or communications signals and that such a use does not constitute a departure from the spirit of the present invention.

Figure 8:
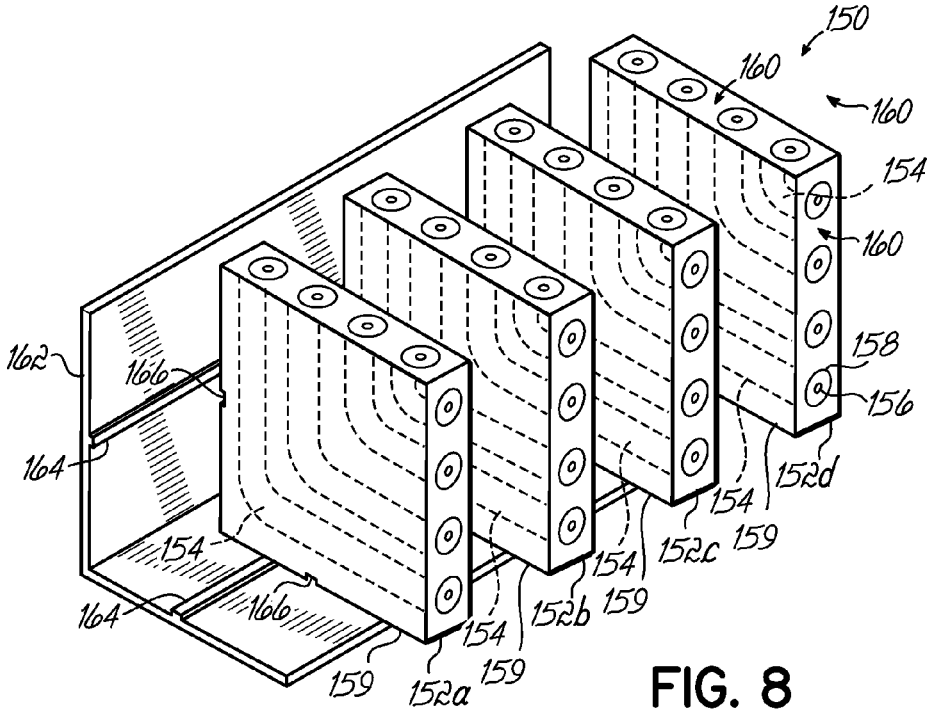
FIG. 8 is an exploded perspective view of a signal array in accordance with principles of the present invention including coaxial conductors.

For example, in one embodiment, circuit boards 132, 134 include at least one pair of corresponding land areas including one central conductive core area. Examples of corresponding lands areas including one central conductive core area located on circuit boards were shown in FIGS. 1 and 2, and the formation of such land areas were described in conjunction with connector assembly 10. FIG. 8 shows a signal array for use with circuit boards 132, 134 when circuit boards 132, 134 include at least one pair of corresponding land areas having one central conductive core area.

Figure 9:
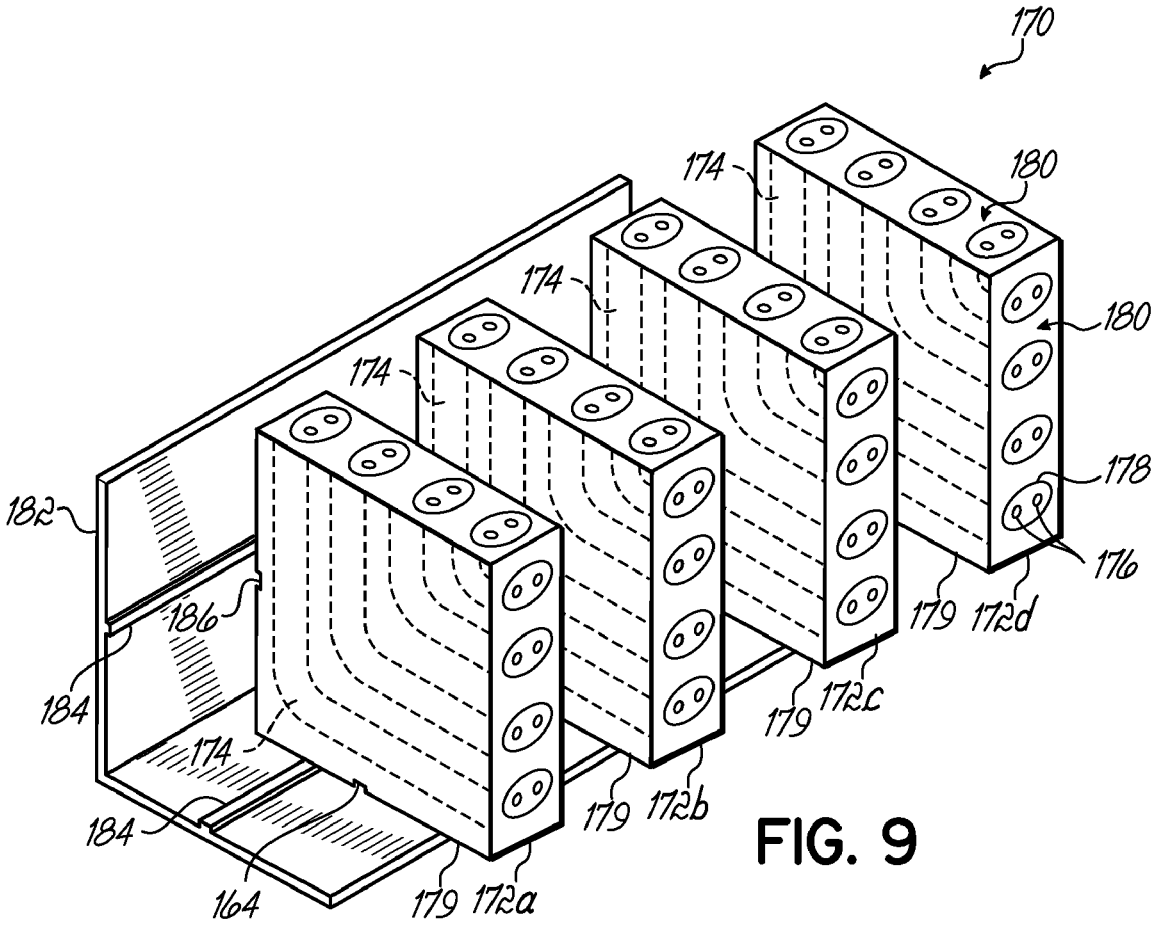
FIG. 9 is an exploded perspective view of a signal array in accordance with principles of the present invention including twinaxial conductors.

In another embodiment, circuit boards 132, 134 include at least one pair of corresponding land areas including two central conductive core areas. Examples of corresponding land areas including two central conductive core areas located on circuit boards were shown in FIGS. 4 and 5, and described in conjunction with connector assembly 70. FIG. 9 shows a signal array for use with circuit boards 132, 134 when circuit boards 132, 134 include at least one pair of corresponding land areas having two central conductive core areas.

With the benefit of the foregoing and, more specifically, connector assemblies 10 and 70, shown in FIGS. 1-3 and 4-6, respectively, those of ordinary skill in the art will readily appreciate the formation of land areas including one or two central conductive core areas on circuit boards 132, 134. Moreover, and although not shown, it will be appreciated that land areas including one or two central conductive core areas on circuit boards 132, 134 extend to traces on multiple layers of circuit boards 132, 134, and to any electrical components soldered to those traces. Such traces with electrical components soldered thereto form circuits on circuit boards 132, 134.

Still referring to FIG. 7, circuit boards 132, 134 may be a backplane and a circuit pack, respectively. In such an embodiment, circuit board 132 may include primarily traces to interconnect numerous circuit packs using multiple connector assemblies described herein, and few, if any, electrical components. Circuit board 134, as well as other similar circuit boards, may include numerous electrical components configured to perform some functionality, and also include connector assemblies described herein.

Circuit boards 132, 134 may also be a motherboard and a daughter card, respectively. In such an embodiment, circuit board 132 may include a processor, e.g., microprocessor, and traces to interconnect numerous circuit packs using multiple connector assemblies described herein. Circuit board 134, as well as other similar circuit boards, may include numerous electrical components configured to perform some function, and also include connector assemblies described herein.

Other embodiments or applications, which lend themselves to two substantially perpendicular circuit boards, will readily appear to those of skill in the art.

Referring now to FIG. 8, an exploded perspective view of signal array 150 for use with circuit boards 132, 134, when circuit boards 132, 134 include land areas having one central conductive core area, is shown. Signal array 150 comprises four blocks 152*a-d*, each including four shielded conductors 154 (shown in phantom line) formed to extend at approximately 90-degree angles or have 90-degree bends. Each shielded conductor 154 includes an inner, axial conductive element 156 and an outer conductive element 158. Shielded conductors 154 may be formed from semi-rigid coax cables well know to those of skill in the art.

Each block 152*a-d* may be constructed by forming pieces of semi-rigid coax at approximately 90-degree angles and casting or molding the coax sections into a non-conductive substance, such as a LCP 159. The conductors 154 are presented at the face surface in a generally co-planar arrangement. The contact or face surfaces 160 may then be machined to improve the co-planarity of the shielded conductors 154 and the interface between the shielded conductors 154 and the compressible interface elements, such as compressible interface elements 138, 140 shown in FIG. 7.

In some embodiments, signal array 150 may further comprise a clip or band 162. Clip 162 includes ribs 164, while blocks 152*a-d* include notches 166, corresponding to ribs 166. Clip 162 functions to holds blocks 152*a-d* together, and aligned, when pressure is applied to signal array 150, such as, for example, clip 141 does when pressure is applied to signal array 136 shown in FIG. 7.

Referring now to FIG. 9, an exploded perspective view of signal array 170 for use with circuit boards 132, 134, when circuit boards 132, 134 include land areas having two central conductive core areas, is shown. Signal array 170 also comprises four blocks 172*a-d*, each including four shielded conductors 174 (shown in phantom line) formed at approximately 90-degree angles or having 90 degree bends. Each shielded conductor 174 includes two axial conductive elements 176 and an outer conductive element 178. Shielded conductors 178 may be formed from semi-rigid twinax well know to those of skill in the art.

Each block 172*a-d* may be constructed by forming pieces of semi-rigid twinax at approximately 90-degree angles and casting or molding the twinax cables into a non-conductive substance, such as LCP 179. The contact surfaces 180 may then be machined to improve the co-planarity of the shielded conductors 174 and the interface between the shielded conductors 174 and compressible interface elements, such as compressible interface elements 138, 140 shown in FIG. 7.

In some embodiments, signal array 170 may also comprise a clip or band 182. Clip 182 includes ribs 184, while blocks 172*a-d* include corresponding notches 186. Clip 182 functions to holds blocks 172*a-d* in alignment when pressure is applied to signal array 170, such as pressure is applied to signal array 136 shown in FIG. 7, such as, for example, clip 141 does when pressure is applied to signal array 136 shown in FIG. 7.

Those skilled in the art will appreciate that although signal arrays 150, 170 are constructed as blocks 152*a-d*, 172*a-d*, respectively, other embodiments of the present invention may be built using similarly functioning signal arrays having wafer type construction. An example of wafer type construction was shown in FIGS. 4-6 and described in conjunction with signal array 76.

Those skilled in the art will also appreciate that a signal array, irrespective of the type of shield conductor used, may be constructed having any size desired. Thus, for example, a signal array need not be constructed having a four-by-four array as shown herein in FIGS. 1-9. Rather, those skilled in the art will readily size or scale the number of conductors in a signal array to meet various circuit requirements and the need to couple high frequency data and/or communications signals between two circuit boards.

Referring once again to FIG. 7, in use, compressible interface element 140 is placed between corresponding shielded land areas, e.g., coaxial or twinaxial, on circuit board 134 and shielded conductors 146 in signal array 136, aligning the central conductive core areas and the conductive outer structure areas of the land areas on circuit board 134 with the axial conductive element(s) and the conductive outer element of shielded conductors 146, respectively. Pressure is applied to compressible interface element 140 to compress the compressible interface element 140 such that the conductive elements within compressible interface element 140 provide electrical connection from land areas on circuit board 134 through the conductive elements to shielded conductors 146.

Pressure may be applied using a variety of fasteners. For example, and as shown in FIG. 7, connector assembly 130 further comprises bolts 144 extending through cross member 148 and circuit board 134 with nuts (not shown) that used to compress, or apply pressure to, compressible interface element 140 coupled between circuit board 134 and signal array 136. Other fasteners may be used in the alternative.

Likewise, connector 138 is placed between corresponding land areas, e.g., coaxial or twinaxial, on circuit board 132 and shielded conductors 146 in signal array 136, aligning the central conductive core areas and the conductive outer structure areas of the land areas on circuit board 132 with the axial conductive element(s) and the outer conductive element of shielded conductors 146, respectively.

Such alignment may be achieved in a variety of ways. For example, and as also shown in FIG. 7, circuit board 132 may be mounted in a fixed location, such as to frame or enclosure 200. In such an example, circuit board 134 may be referred to as a backplane or a mother board. Frame or enclosure 200 includes guides or slides 202 for receiving circuit boards, such as circuit board 134. Additional slides may be included for other circuit boards. Circuit board 134 is inserted into guides or slides 202 such that circuit boards 132, 134 are substantially orthogonal.

Pressure is also applied to compressible interface element 138 to compress compressible interface element 138 such that the conductive elements within compressible interface element 138 provide electrical connection from land areas on circuit board 132 through the conductive elements to shielded conductors 146. Such pressure may be provided by latch 204 mounted to circuit board 134, that articulates and engages slide 202, applying pressure to compressible interface element 138.

When compressible interface elements 138, 140 are compressed, those conductive elements contacting the outer conductive elements of shield conductors 146 and the conductive outer structure areas of land areas on circuit boards 132, 134 form a shield around, or "shield", those conductive elements contacting the axial conductive elements of shield conductors 146 and the central conductive core areas of the land areas on circuit boards 132, 134. Thus, when compressible interface elements 138, 140 are compressed, conductive elements of compressible interface elements 138, 140 "extend" the geometric arrangement and/or shielding of shield conductors 146 through to land areas, or the surface, of circuit boards 132, 134.

Shielded conductors 146 accompanied by compressible interface elements 138, 140 that extended the shielding of those conductors may be used for single-ended or differential signals, based on the number of axial conductive element in a shielded conductor, such as high-speed data and/or communications signals. Shielding is particularly useful in preventing interference when using such high-speed or high frequency signals. Moreover, shielding prevents "crosstalk" between shielded conductors placed in close proximity with one another, and facilities the construction of dense or tightly spaced arrays of shielded conductors.

In addition, connector assembly 130 capitalizes on the benefits of elastomeric connectors, e.g., compressible interface elements 138, 140, in providing high frequency data and/or communications connections between circuit boards 132, 134. In doing so, connector assembly 130 requires no soldering. Further, no soldering or special skill is required to remove and replace one of the compressible interface elements 138, 140 or the signal array 136. A user need only release latch 204, remove circuit board 134 from slides 202 and frame 200, and/or remove fasteners 144, reposition the new compressible interface elements 138, 140 and/or signal array 136, and reinstall the fasteners 144 and circuit board 134. Also, connector assembly 130 includes no pins that may be bent or broken in inserting circuit board 134 in slides 202, resulting in a failure of the product the circuit boards 132, 134 are included in, either under production test or in the possession of a user or consumer. Connector assembly 130 also extends the geometric arrangement of the shielded conductors 146 in signal array 136 through connector assembly 130 to the surface of the circuit boards 132, 134. By extending the geometric arrangement, with its inherent shielding, crosstalk between shield conductors in the array is reduced, while the variation in impedance with changes in frequency of each respective shielded conductor 18 is also reduced. Thus, connector assembly 130 improves the replacement and serviceability of high-speed data and/or communications connections.

Figure 10:
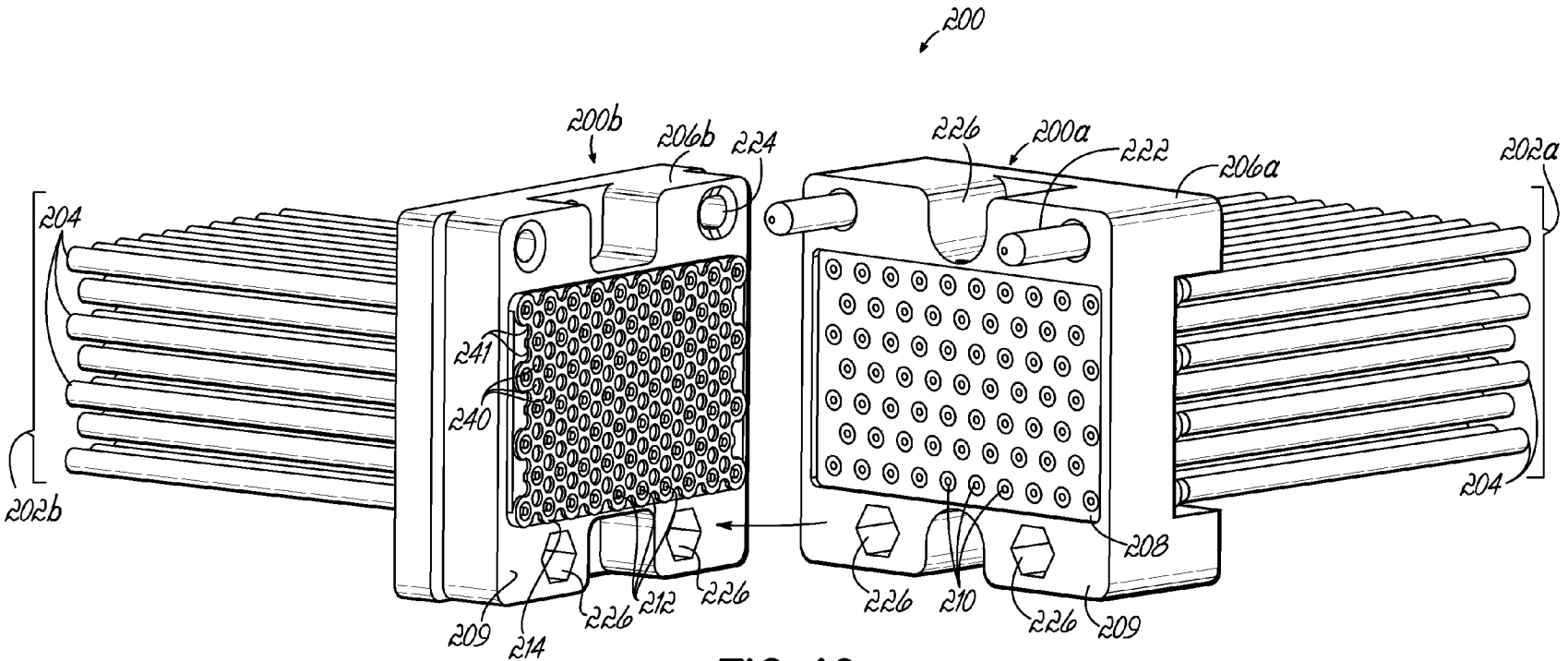
FIG. 10 is a perspective view of connector assemblies of the present invention.

FIG. 10 illustrates another embodiment of the invention forming a connector assembly utilizing a compressible interface element. Specifically, the connector assembly 200 includes connector assemblies 200*a*, 200*b* that couple together signal arrays 202*a*, 202*b*. The signal arrays may in turn be coupled signal-bearing components (not shown) such as circuit boards or other electronic components. The arrays 202*a*, 202*b* are each shown including a plurality of individual conductors, such as cables 204, each carrying a signal. FIG. 10 illustrates a connector assembly wherein two cable arrays are connected with each other. However, as noted above and in the embodiments shown in FIGS. 13 and 14, the connector assemblies can be utilized to couple a signal array of a plurality of cables to another signal-bearing component, such as a circuit board.

The individual conductors or cables 204 of each array 202*a*, 202*b* include one or more inner conductive elements and an outer conductive element. In a coaxial configuration, as illustrated in FIG. 10, a single inner conductive element or center conductor is surrounded by an outer conductive element or outer conductor, such as a braid or shield, as is known in the art. Of course, the embodiment as illustrated in FIGS. 10-15 may also be utilized for a twin-axial arrangement, as illustrated in FIGS. 4-6 and 9. Therefore, the invention is not limited to the illustrated embodiment.

In the embodiment of the connector assembly 206*a*, 206*b*, as illustrated in FIG. 10, the ends of the array cables terminate in a respective body 206*a*, 206*b* formed of a conductive material, such as metal. For example, body 206*a*, 206*b* might be machined out of a piece of brass or stainless steel. Each body defines a face surface 208, which is in a generally co-planar arrangement with the terminated ends of the cables of the signal arrays 202*a*, 202*b*. Specifically, the inner conductive elements 210 of the cables of the array are presented at the face surface 208 in a generally co-planar arrangement for presenting the signal array (i.e., 202*a*) to another signal-bearing component, such as another connector assembly (e.g., 202*b*) or a circuit board. The conductive connector body, and specifically the face surface 208 defines an outer conductive element, such as a ground reference, surrounding each of the inner conductive elements. In the embodiment illustrated in FIG. 10, the connector assembly 200 includes connector assemblies 200*a* and 200*b* as the signal-bearing components of the overall assembly. Connector assembly 200*b* is similarly arranged, wherein signal array 202*b* includes cables, which have inner conductive elements 212, which terminate in a face surface 214. In accordance with one aspect of the invention, a compressible interface element 220 is positioned between the face surfaces 208, 214 of connector bodies 206*a*, 206*b*. As noted above, the compressible interface element has a plurality of conductive elements embedded in a compressible, electrically insulated medium (see FIG. 11). As discussed further below, the connector bodies 206*a*, 206*b* are configured to be complementary.

Figure 11:
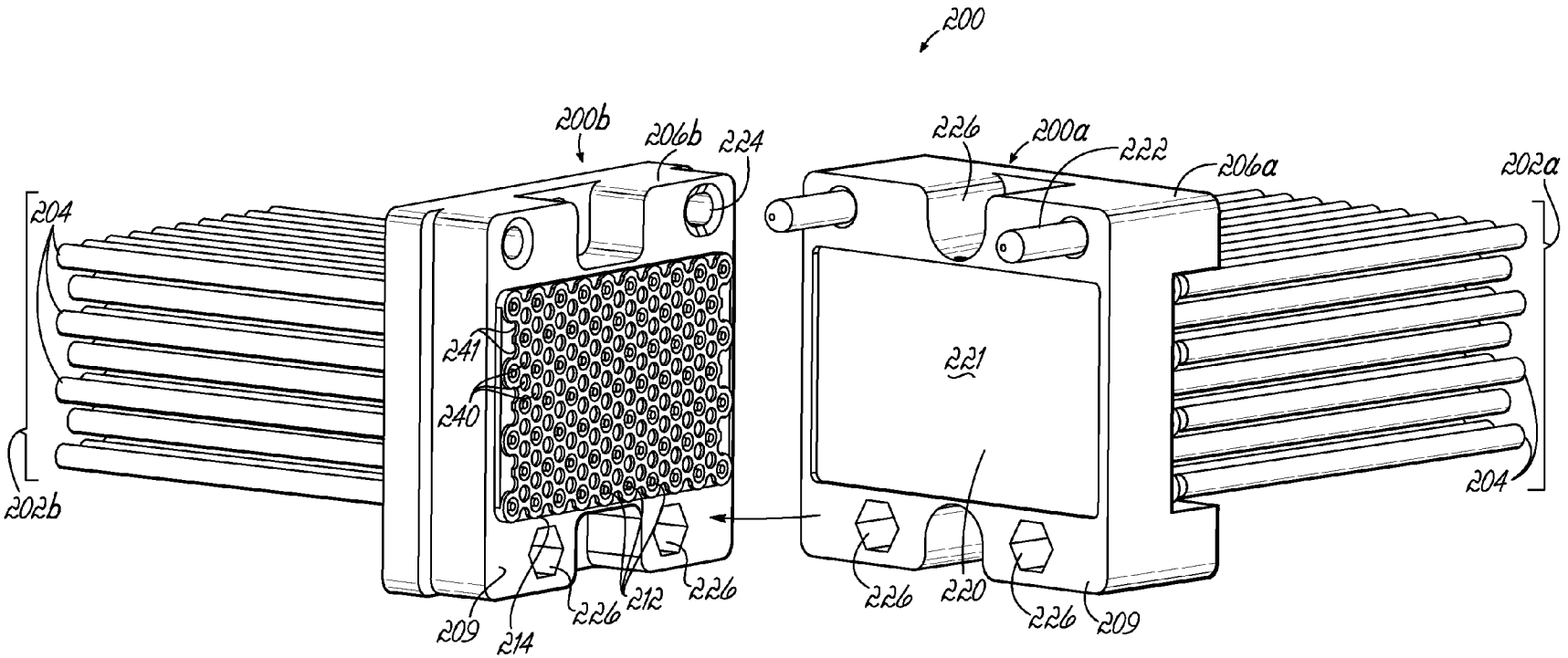
FIG. 11 is a perspective view similar to FIG. 10 showing a compressible interface element in position.

Referring to FIG. 11, the interface element 220 is positionable against the face surfaces 208, 214 of one of the connector bodies, such as connector 206*a*, and is operable for being compressed between the connector body 206*a*, and another signal bearing component, such as the connector body 206*b* of assembly 200*b*. When compressed, the interface element 220 presents the signal array of connector assembly 200*a*, to the signal-bearing component, such as connector assembly 200*b* to pass the signals of array 202*a* to array 202*b*, while maintaining a geometric arrangement of the inner and outer conductive elements of the cables of the two arrays. That is, the present invention of FIGS. 10, 11 provides a cable array-to-cable array connector assembly without male-female connector elements or pins or solder connections, while maintaining the geometric arrangement of the conductive elements of the cables and, in the case of connector assembly 200, a co-axial geometric arrangement for the individual cables of the array.

For the purposes of alignment, the bodies or blocks 206*a*, 206*b* utilize alignment pins 222 and corresponding alignment openings 224 to ensure that the inner conductive elements of the cables of one array interface properly with the inner conductive elements of the other arrays. The outer conductive elements are also similarly aligned. Appropriate openings 226 are utilized to receive appropriate fasteners, such as jack-screws, to hold the bodies 206*a*, 206*b* together and thus compress the compressible interface element 220 to provide a proper electrical connection between the arrays. As may be appreciated, the present invention provides a quick connect and quick disconnect connector assembly that does not require significant amounts of force to provide a proper signal interface, nor does it provide the male/female insertion requirements utilized with typical co-axial or pin-type connectors. Because of the unique configuration of the connector assembly of the invention, the high performance characteristics are maintained for high frequency signals.

The present invention provides significant performance, similar to coaxial connectors, while providing its other advantages as noted herein. For example, the VSWR measurement, made through two mated bodies and the interface element, was 1.07:1, up to 20 GHz. This is similar to the VSWR in a typical coax cable. Furthermore, the impedance measured through the mated bodies and interface element was around 50 Ohms±3 Ohms, which is comparable to a typical coaxial connector.

The insertion loss and cross talk characteristics were also favorable for the invention. Measuring an insertion loss through a 3-foot coaxial cable with and without the connector of the invention yielded an insertion loss around −0.7 dB. The cross talk, up to 40 GHz, was low enough to certify the nature of a true RF path through the connector assembly of the invention. Specifically, the cross talk measured by injecting a signal in a cable at one side of the mated connector bodies and interface element, and measuring a signal at an adjacent cable on the other side of the connector assembly yielded a signal about −80.0 dB down from the input signal. This is similar to what is achieved in a coax cable.

Figure 12A:
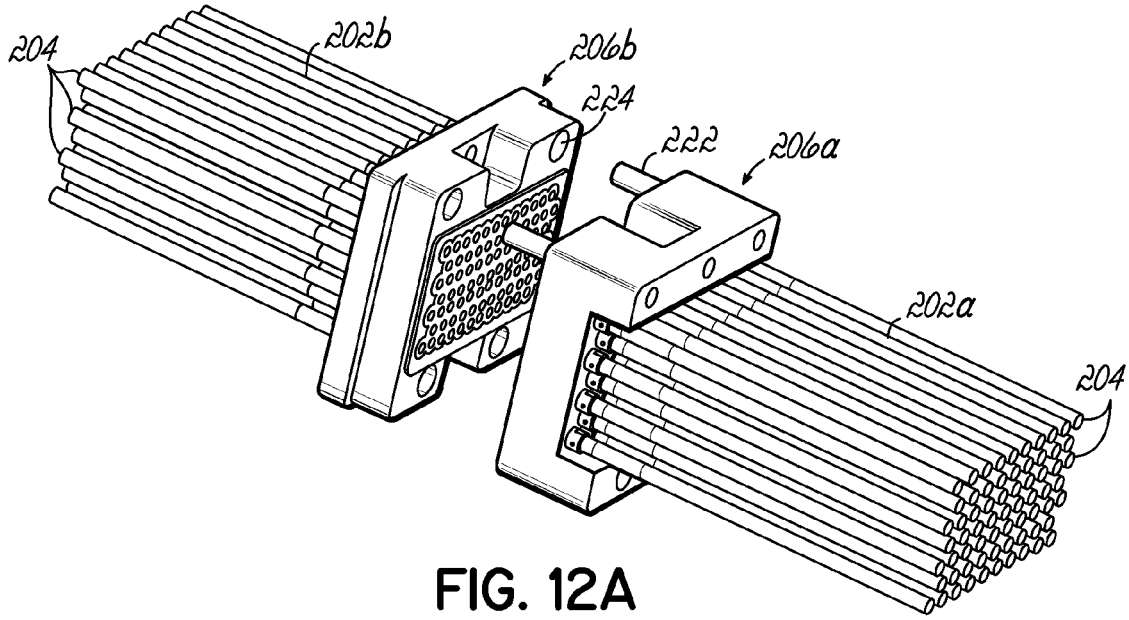
FIG. 12A illustrates a pair of connectors aligned to be connected.
Figure 12B:
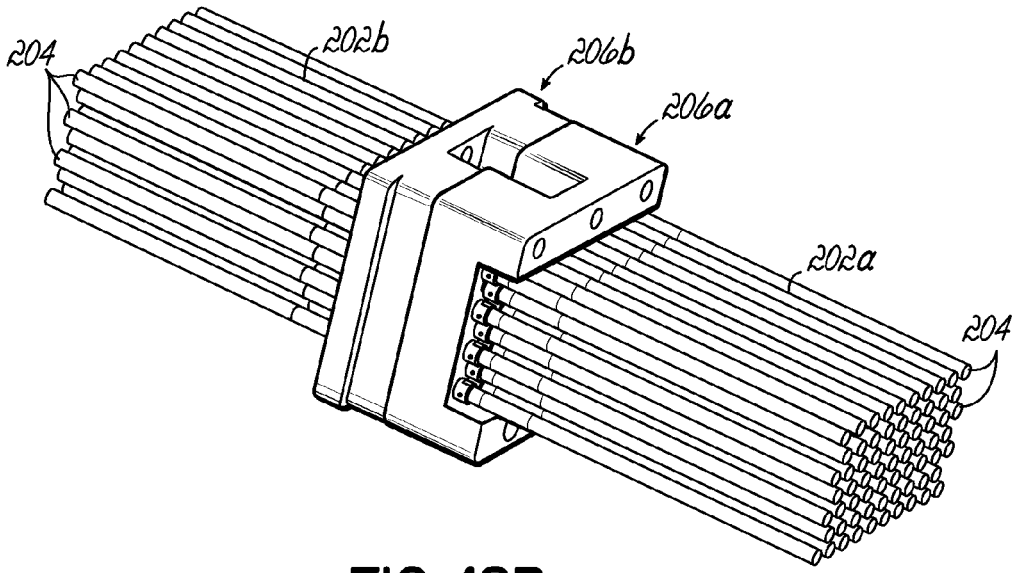
FIG. 12B illustrates the cross-sectional view of connectors coupled together through an interface element in accordance with the present invention.

FIGS. 12*a* and 12*b* illustrate proper connection of the connector assembly 20 in order to compress the interface element 220 and provide the desired connection.

In the embodiment of FIG. 10, a connector body, such as body 206*a*, incorporates a plurality of openings formed therethrough and in the face surface 208 for presenting the inner conductive elements (e.g., center conductor or conductors) and outer conductive elements (e.g., shield) at the face surface in a planar presentation for interfacing with a generally flat or planar face 221 of the interface element 220. For the purpose of illustration, body 206*a* is discussed, but body 206*b* may be similarly constructed to interface the terminator ends of the cables of the signal array with the connector body.

Figure 12C:
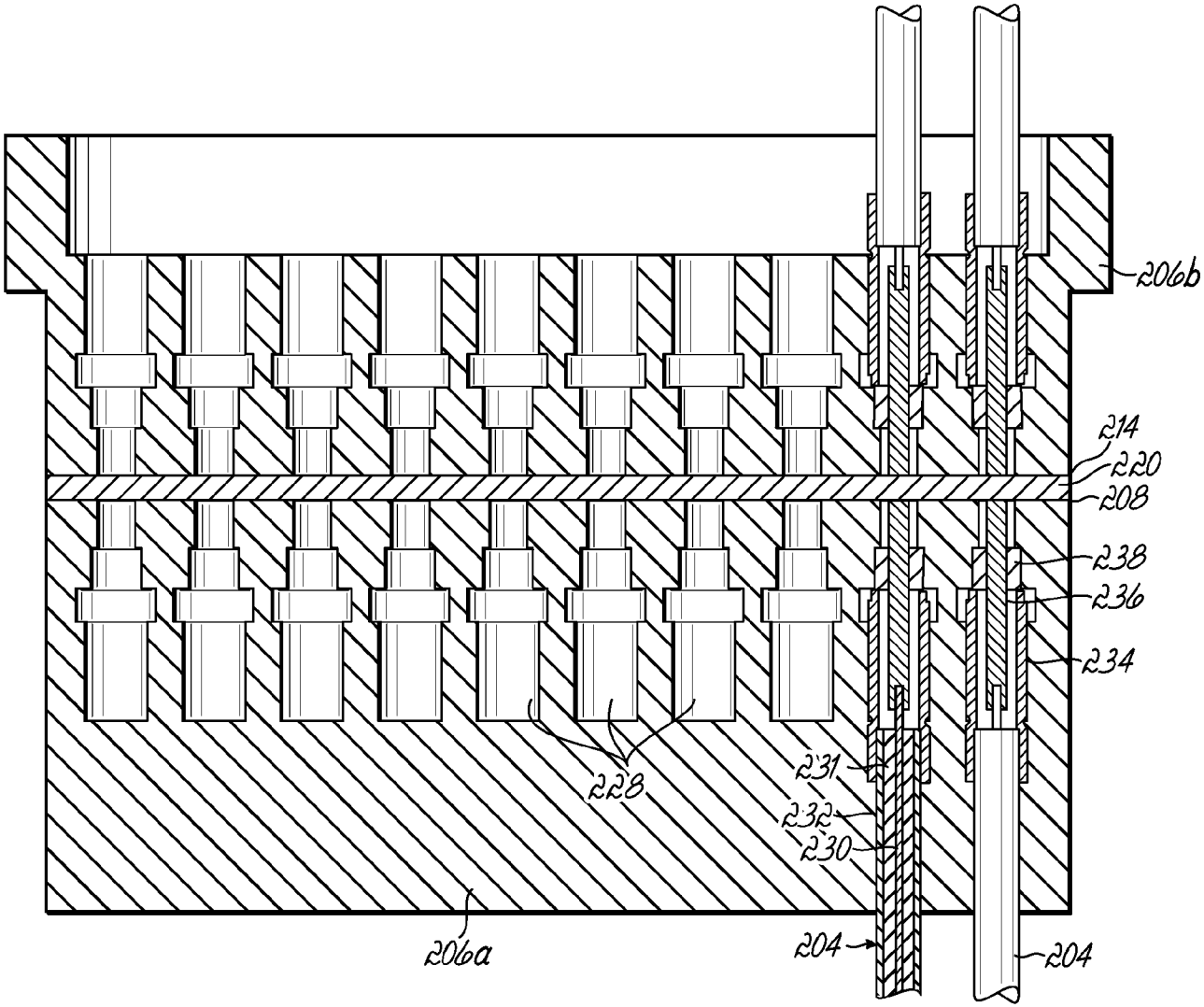
FIG. 12C illustrates a cross-sectional view of connectors coupled together through an interface element in accordance with the present invention.

Turning to FIG. 12C, a cross-sectional view of a connector assembly is illustrated with two connector bodies coupling arrays together with a compressible interface element. As may be seen in FIGS. 10, 11, the face surfaces 208, 214 are countersunk and raised, respectively, but such features are not in FIG. 12C for illustration purposes. Specifically, connector body or block 206*a* includes a plurality of bores 228 formed therethrough. Each of the connector conductor cables 204 incorporates a center conductor 230 embedded in a dielectric and an outer conductor or shield 232. Such an arrangement is well known in cable assembly and is referred to as coaxial. The exposed ends of the cable are coupled with respective ferrules 234, which are inserted into the bores or openings 228. The cables 204 are terminated by first exposing the center conductor 230 and the outer conductor 232 at the termination end of the cable. Generally, the center conductor 232 may be exposed by removing the dielectric material from around it such that the center conductor extends slightly beyond the remaining dielectric 231 and the termination end of the outer conductor 232 as illustrated in FIG. 12C. The end of the cable and the exposed center conductor 230 are inserted into the ferrule 234, and the outer conductor or shield 232 is electrically coupled to the ferrule, such as by being soldered.

Figure 15:
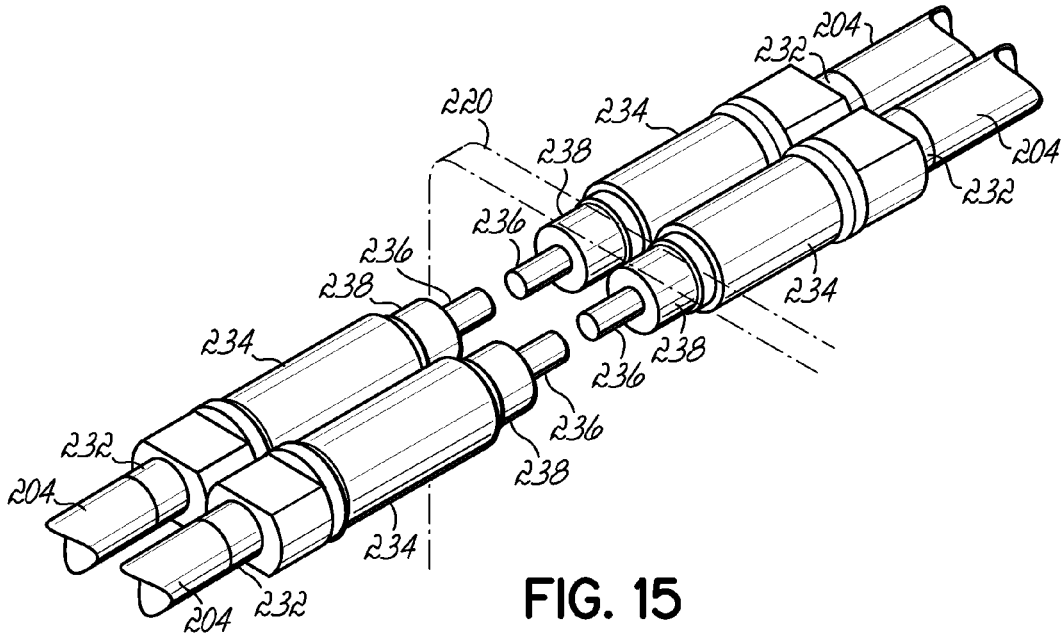
FIG. 15 is a perspective view of cables of an array of a connector assembly showing inner conductive elements coupled through the compressible interface element.

Referring again to FIG. 12C, an inner contact element 236 is also pressed onto the exposed center conductor 231 of the cable. The contact element 236 is configured to grip the center conductor 231, and may have spring fingers to that end. The combination of the center conductor and the inner contact element 236 essentially provides the inner conductive element of each cable of the signal array as presented in a generally co-planar arrangement at the face surface 208. The inner contact extends forward from the ferrule in the opening 228 and the end of the inner contact is presented as element 210 at the face surface 208 as illustrated in FIG. 10. Also positioned in the openings 228 and around each inner contact 236, is an insulator element 238, such as a dielectric element as illustrated in FIGS. 12C and 15. With the ferrule 234, inner contact element 236, and insulator element 238, positioned on the termination end of the cable, the cable end is positioned in opening 228 and secured in place. For example, the ferrule might be pressed or screwed into the respective opening 228. Alternatively, it might be further secured, such as by glue. As illustrated in the cross-section of FIG. 12C, the openings 228 are appropriately formed to receive the shaped ferrules as well as the insulator element 238 and the inner contact element 236 to center the inner contact and form the inner conductive element of the signal array as illustrated in FIG. 10. The isolator element isolates and centers the contact element in the opening as shown in FIG. 15. The openings 220 are appropriately formed with a step or shoulder to capture the front end of the insulator element 238 to prevent it from going completely through the opening. Thus, the insulator element 238 is trapped between the ferrule 234 and the step of opening 228 to not only insulate the inner conductive element from the respective conductive body 206*a*, but also to center the inner conductive element within the opening 228. The ferrule 234 is secured in the block or body 206*a* by suitable means. The ferrule 224 is preferably metal and thus is electrically coupled to the conductive body 206*a*. In such an embodiment, the metal body provides the outer conductive element of the signal array for all the conductors or cables. Generally, the outer conductors are shielded and the cables are grounded and, thus the conductive body 206*a* provides a common ground for each of the inner conductive elements of the array 206*a*, 206*b*.

Referring to FIG. 10, the face surface 208 is thus a grounded face surface or ground reference for the signal array.

In one embodiment of the invention as shown in FIGS. 10, 11, the face surface 208 is countersunk with respect to a front surface 209 of the conductive body 206*a*. Such a countersunk face surface 208 is illustrated on connector body 206*a*. Alternatively, the front surface might be raised with respect to the face surface 209 of the body, as illustrated with connector body 206*b*, wherein the face surface 214 is raised above front surface 209 of that connector body. In the embodiment illustrated in FIG. 10, one connector assembly 200*a* utilizes a countersunk face surface, wherein the other connector assembly 200*b* utilizes a raised face surface. Alternatively, both face surfaces 208, 214 may be countersunk or both may be raised with respect to the front surface 209 of their respective connector bodies. In another embodiment of the invention, not shown, the face surface 208, 214 might be flush with respect to the front surface 209 of the body 206*a*, 206*b* of the connector.

In the embodiment shown in FIGS. 10, 11, the size of the countersunk area 208 corresponds with the raised area 214, and both areas correspond with the interface element, to rest together when the connector assemblies are brought together. Of course, such nesting is not a necessity.

Thus, in accordance with one aspect of the invention, the geometric arrangement of the inner and outer conductive elements is presented at the respective face surface of the connector bodies 206*a*, 206*b*. In combination with the compressible interface element, such as an elastomeric connector interface 220, the coplanar center conductors and ground reference ensure that high frequency RF signals may be passed from array 202*a* to the array 202*b*, or vice versa, while maintaining desirable performance characteristics in the connector assembly 200.

Figure 17:
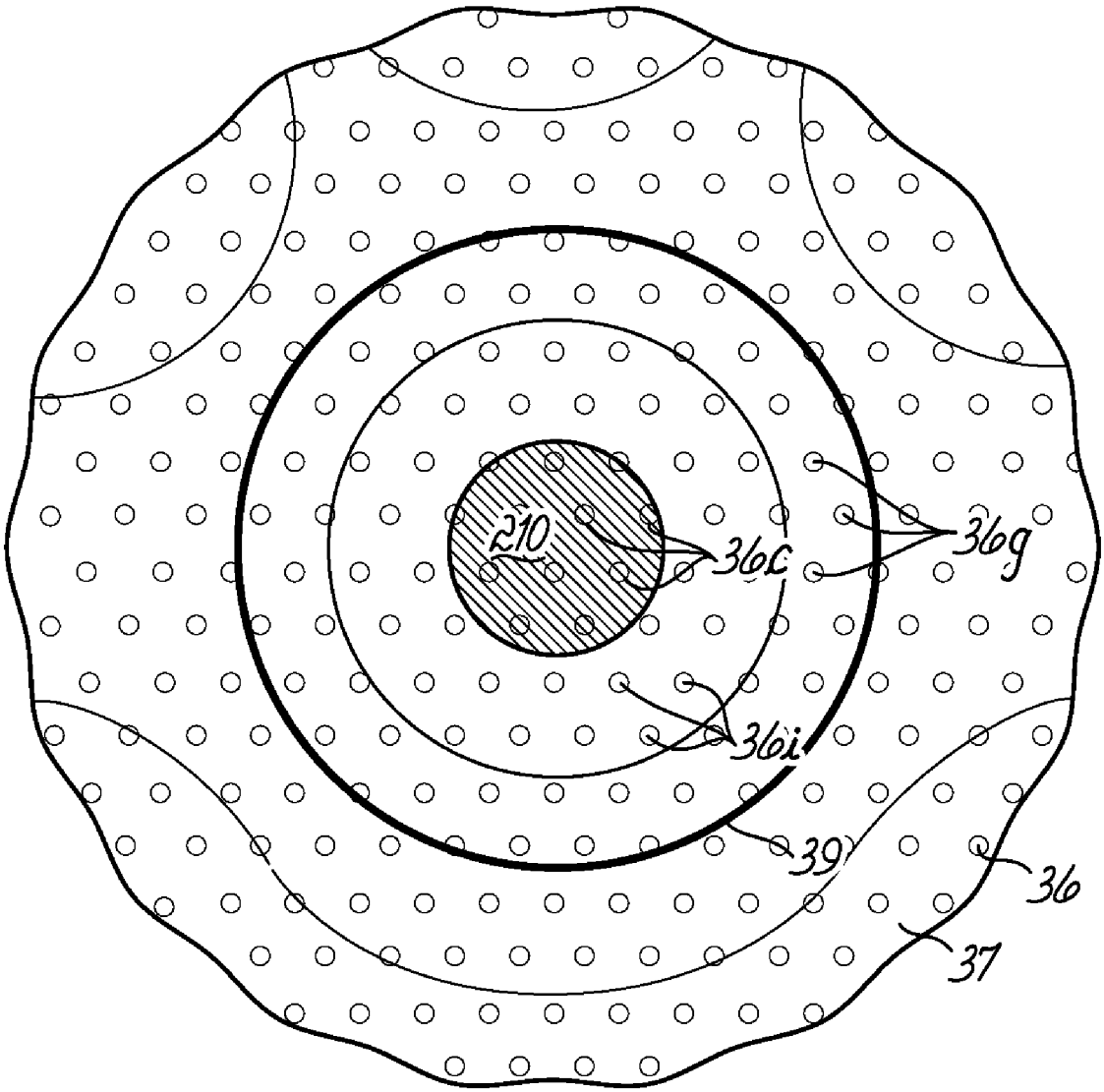
FIG. 17 is an illustrative cross-sectional view of an array cable of the present invention interfacing with a compressible interface element.

As illustrated in FIGS. 2 and 5, the compressible interface element utilizes a plurality of conductive elements embedded in the compressible, electrically insulative medium. Those conductive elements are generally spaced in a gridlike fashion throughout the electrically insulated medium, as illustrated in FIG. 17. The conductive elements 36 embedded within the insulative medium 37 are contacted, simultaneously at opposite ends, by the face surfaces 208, 214 to effectively provide a 360° electromagnetic shield coverage around the inner conductive element when the compressible interface element is compressed. As illustrated in FIG. 17, the reference signal provided in the shields of the cable, such as a ground reference, is presented at the face surfaces 208, 214 of the connector bodies 206*a*, 206*b*. When the compressible interface element is compressed, multiple conductive elements 36 are engaged all the way around the inner conductive element 210 as illustrated by the reference circle 39 to form a 360° electromagnetic shield therearound. The shielded, or grounded, elements 36 are indicated by the reference numeral 36*g* and represent the outer conductive element for the various cables of the signal array. Similarly, the inner conductive element 210 contacts multiple elements 36*c* to pass the signal between the inner conductive elements, or center conductors, of the signal arrays. The inner conductive elements 210, 212 in the embodiment illustrated in FIG. 10 are surrounded by air. Thus, when the compressible interface element 220 is compressed between the connectors 200*a*, 200*b*, conductive elements 36*i* do not pass any signal or voltage/current and, thus, provide an insulative layer between the center elements 36*c* and the elements 36*g* forming the outer shield.

FIGS. 10 and 11 illustrate connector assembly 200*b* wherein the face surface 214 is raised or elevated above the front surface 209 of body 206*b*. In accordance with one aspect of the present invention, the amount of force necessary to compress the compressible interface element 220 between connector assemblies 200*a* and 200*b* while maintaining geometric arrangement of the inner and outer conductive elements of the cables of the array through the connection, may be lessened by forming recesses 240 in the face surface 214. Generally, as shown in FIG. 10, the recesses 240 are adjacent to the openings containing the inner conductive elements 212 in connector assembly 200*b*. The compressible insulative material, or medium 37, thus passes into not only the openings formed to receive the respective cables 204, but also into the recesses 240, when the interface element 220 is compressed to provide a connection with the desired high performance characteristics, but a low amount of force necessary to provide adequate signal passage between the arrays 202*a* and 202*b*. Similar to the recesses 240, milled out areas 241 might also be utilized at face surface 214 so that less pressure is necessary for a proper connection when compressing element 220. As noted above, while FIGS. 10 and 11 illustrate an embodiment wherein the face surfaces 208, 214 are respectively countersunk and raised, both surfaces may resemble face surface 208 or both surfaces may resemble face surface 214. Alternatively, one or more or the surfaces may essentially be flush with the front surface 209 of the respective connector body 206*a*, 206*b*. As illustrated in FIG. 11, the compressible interface element 220 might be sized to correspond with the face surface 208, and to actually seat into a countersunk face surface 208, as illustrated in FIG. 11. Similarly, the raised face surface 214 may be sized to nest into the countersunk face surface 208 to capture inner face element 220 therebetween. In that way, proper alignment of the interface element 220 might be ensured. A suitable thickness for interface element 220 is in the range of 0.13 mm to 1.0 mm, and might be obtained commercially from Fugipoly of Japan, Paricon Technologies Corporation of Fall River, Mass., and Shin-Etsu Polymer Corporation of Japan.

Figure 13:
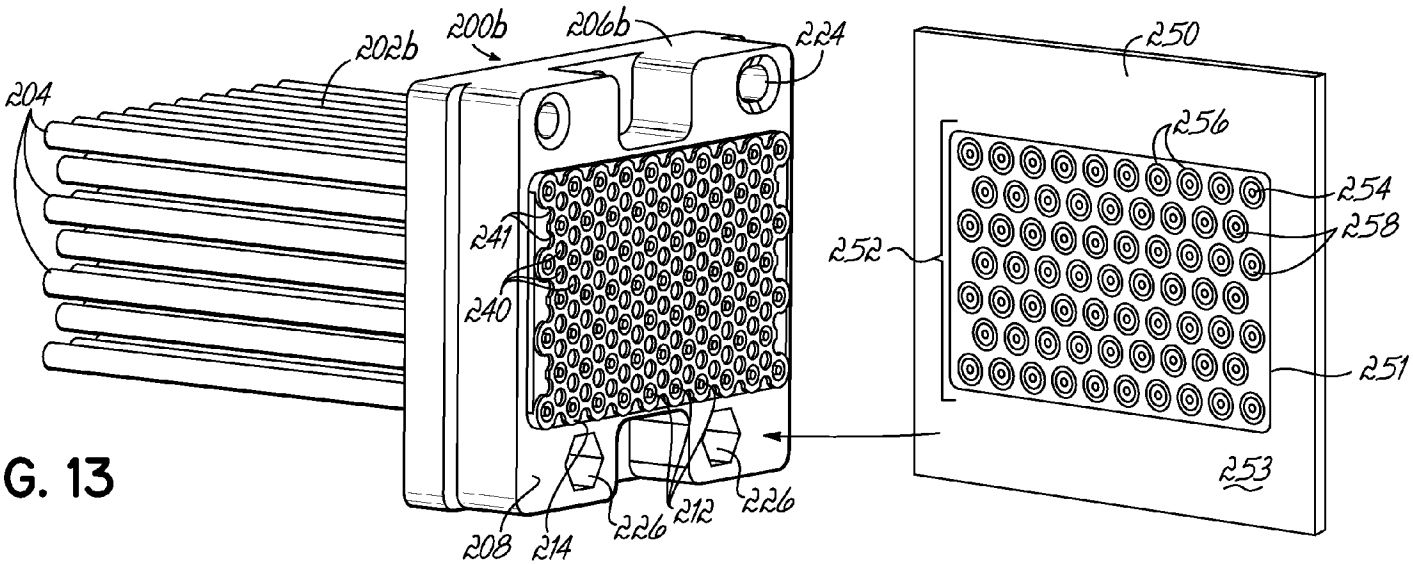
FIG. 13 is a perspective view of another connector assembly of the present invention.
Figure 14:
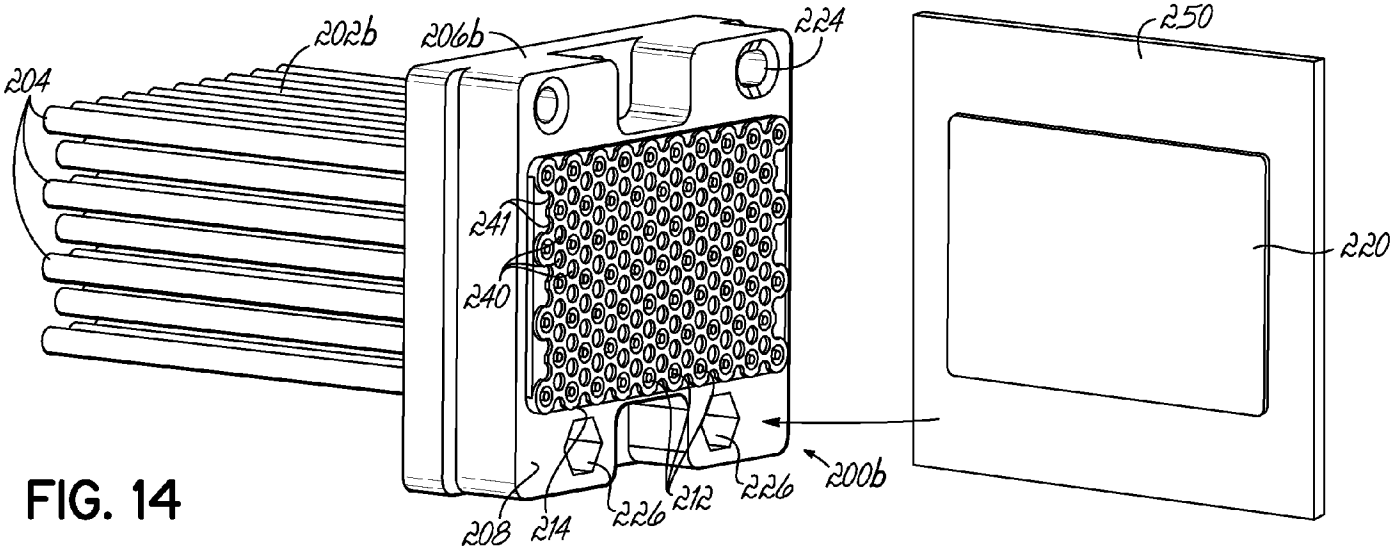
FIG. 14 is a perspective view similar to FIG. 13 showing a compressible interface element in position.

FIGS. 13 and 14 illustrate an alternative embodiment of the invention wherein the overall connector assembly includes a signal-bearing component, such as circuit board having a plurality of traces or land areas formed thereon. The circuit board is coupled to a signal array. The signal array and conductive body shown in FIGS. 13 and 14 resembles the connector assembly 200*b*, as illustrated in FIGS. 10 and 11. Alternatively, connector assembly 200*a* might be utilized, or an equivalent version, in accordance with the aspects of the present invention. Referring to FIG. 13, a circuit board 250 has traces formed thereon that generally form a plurality of signal bearing elements 252 for passing multiple signals between the board and an array of cables 204. The signal bearing elements illustrated in FIGS. 13 and 14 are coaxial in nature. However, traces might be formed for other types of arrangement utilizing at least one inner conductor and an outer conductor, e.g., twinax arrangement.

Specifically, the signal bearing elements 252 utilizes a plurality of inner conductive traces 254 and outer conductive traces 256. As is conventional, the inner conductive traces 254 may represent signal conductors, wherein the outer conductive traces 256 may represent shielding or a ground reference for the signals on the traces 254. The area 258 between the inner and outer conductor traces is nonconductive may or may not include a separate dielectric material within the circuit board construction. Generally, the circuit board 250 may be formed in any suitable manner known to a person of ordinary skill in the art with respect to circuit boards, wherein conductive metal traces are deposited or otherwise formed within a multiple layer construction. The section 251 of the circuit board that contains the signal-bearing elements is at least one of raised, flush or countersunk with respect to surface 253 of the circuit board. The embodiment of FIGS. 13, 14 shows a flush section 251, although it might be countersunk similar to face surface 208 of FIG. 10 to nest with the face surface 214 as in FIGS. 10, 11.

A compressible interface element 220 may be sized and configured to overlay the signal bearing elements 252 of circuit board 250 as illustrated in FIG. 14. Then, when the circuit board 250 and the connector 200*b* are compressed together, the interface element is compressed between the signal array and the signal bearing elements while maintaining a geometric arrangement of the inner and outer conductive elements of the array and circuit board so as to pass the signals properly from the array to the circuit board, and vice versa. As noted above, the compression of the interface elements, while maintaining a geometric arrangement of the inner and outer conductive elements, forms a 360° shield around the inner conductive element, or center pin 212, and thus provides the desired performance characteristics of the invention.

The embodiment of the invention illustrated in FIGS. 10-14 utilize connector bodies or blocks that are electrically conductive and thus provide an electrical reference, such as a ground reference, for the inner conductive elements of the signal array. That is, the conductive body brings the shield reference forward from the terminated ends of the cables of the signal array to the respective face surfaces at which the inner conductive elements are presented. In an alternative embodiment of the invention, the body might be formed of an electrical insulative material such as plastic. To that end, the reference signal or ground of the outer conductive elements of the array must be presented to the face surface in an alternative fashion.

Figure 16:
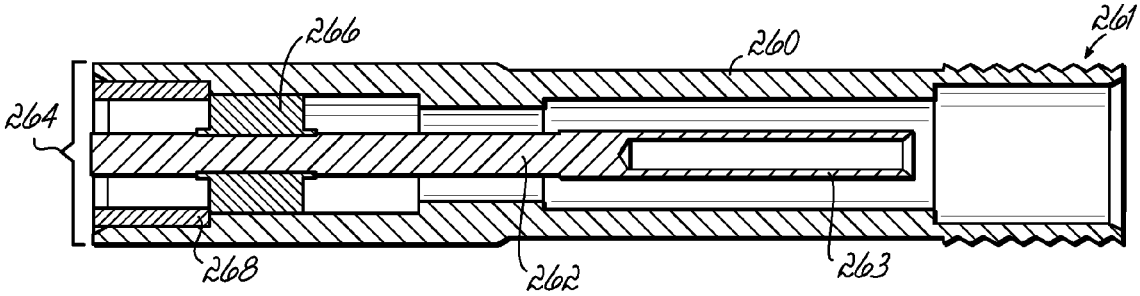
FIG. 16 is a side cross-sectional view of a conductive element for coupling an array cable to a connector body.

FIG. 16 illustrates one possible element to terminate a cable in the connector body for providing the outer conductive element at the face surface. Specifically, a ferrule with a conductive outer body 260 is soldered at end 261 to a shield or an outer conductor of a cable terminated within the outer body 260. An inner contact 262 interfaces with the center conductor of the respective cable and is electrically conductive. For example, the inner contact might include a bifurcated end 263 that frictionally holds the exposed center conductor of the cable. The conductive outer body 260 is positioned with the inner contact 262 to extend forward to present an end 264 where both an outer body and inner contact are presented generally in a co-planar fashion. The inner contact might extend slightly forwardly of the end if the outer body. Similar to the ferrule, as described in the embodiments of FIGS. 10, 11, and 12C, an insulator element 266 might be positioned around inner contact 262 to provide insulation and positioning of the inner contact with respect to outer body 260. A bushing 268, which may be generally cylindrical in shape, is press fit into the end of the outer body 260 to hold the insulator element 266 in place. The bushing preferably is electrically conductive and thus provides part of the outer conductive element of the signal array. The outer body 260 may then be pressed fit or otherwise secured into an appropriate opening within a conductive body illustrated in FIG. 12C. In such an arrangement, a connector body made of a nonconductive material might be utilized and the face surface of the connector body would not provide the outer connector element or ground reference of the signal array. Rather, the outer body would provide such an outer conductive element and would pass the signal, such as a ground reference, of a cable shield forward to the face surface to be presented to the compressible interface element and then to another connector assembly or a circuit board or other signal-bearing component in accordance with the principles of the present invention.

Figure 18:
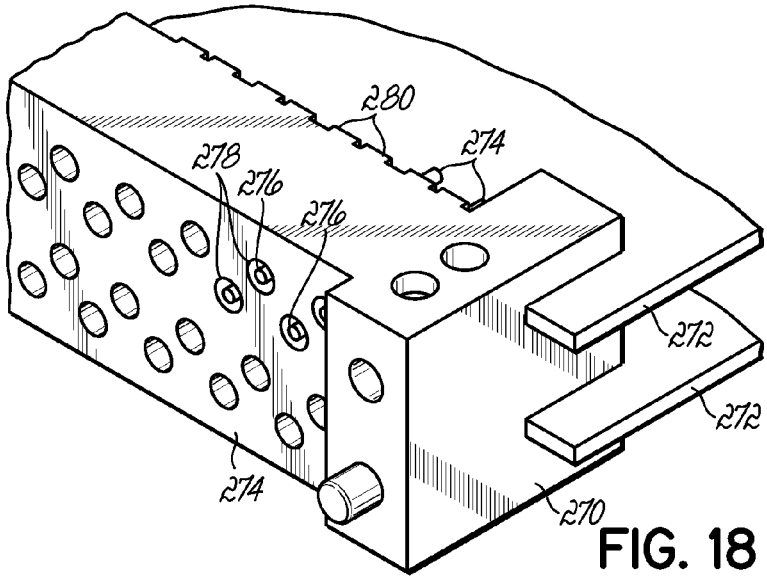
FIG. 18 is an alternative embodiment of a connector assembly of the invention for connecting circuit boards with other signal-bearing components in accordance with principles of the invention.

FIG. 18 illustrates another alternative embodiment of the invention, wherein the end of a circuit board is utilized to interface with a signal array. To that end, a body 270 might interface with an edge of one or more circuit boards 272. The circuit boards 272 may include one or more traces 274 thereon, which couple with inner conductive elements 276 extending through the body 270. The inner conductive elements are presented at a face surface 274 of body 270 in a generally coplanar arrangement for presenting the signals from the circuit boards to another signal bearing component, such as a cable array, or another printed circuit board having a similar arrangement. The inner conductive elements 276 are centered within openings 278 appropriately formed in body 270. Body 270 might be a conductive body and may be coupled to appropriate ground traces 280 formed on the circuit boards 272. In that way, the body 270, and specifically the face surface 274 of the body, provides the outer conductive element, which may carry a ground reference, for example, for each of the respective inner conductive elements of the circuit board or signal array. That is, the face surface provides a ground reference surrounding each of the inner conductive elements. Alternatively, if the body 270 is nonconductive, a suitable arrangement such as that illustrated in FIG. 17 may be utilized to present an inner conductive element and an outer conductive element of the array to face surface 274. Utilizing a compressible interface element 220 in accordance with the principles of the present invention, and positioning the interface element against face surface 274 and against the face surface of another conductive connector body, such as that illustrated in FIGS. 10 and 11, or another signal-bearing component, such as a circuit board like that illustrated in FIGS. 13 and 14, or even the face surface presented by another duplicate signal array such as that shown in FIG. 18, the geometric arrangement of the inner and outer conductor elements or inner elements and respective ground references of the signal array presented at face surface 274 is maintained with the desired performance characteristics provided by the invention.

Figure 20A:
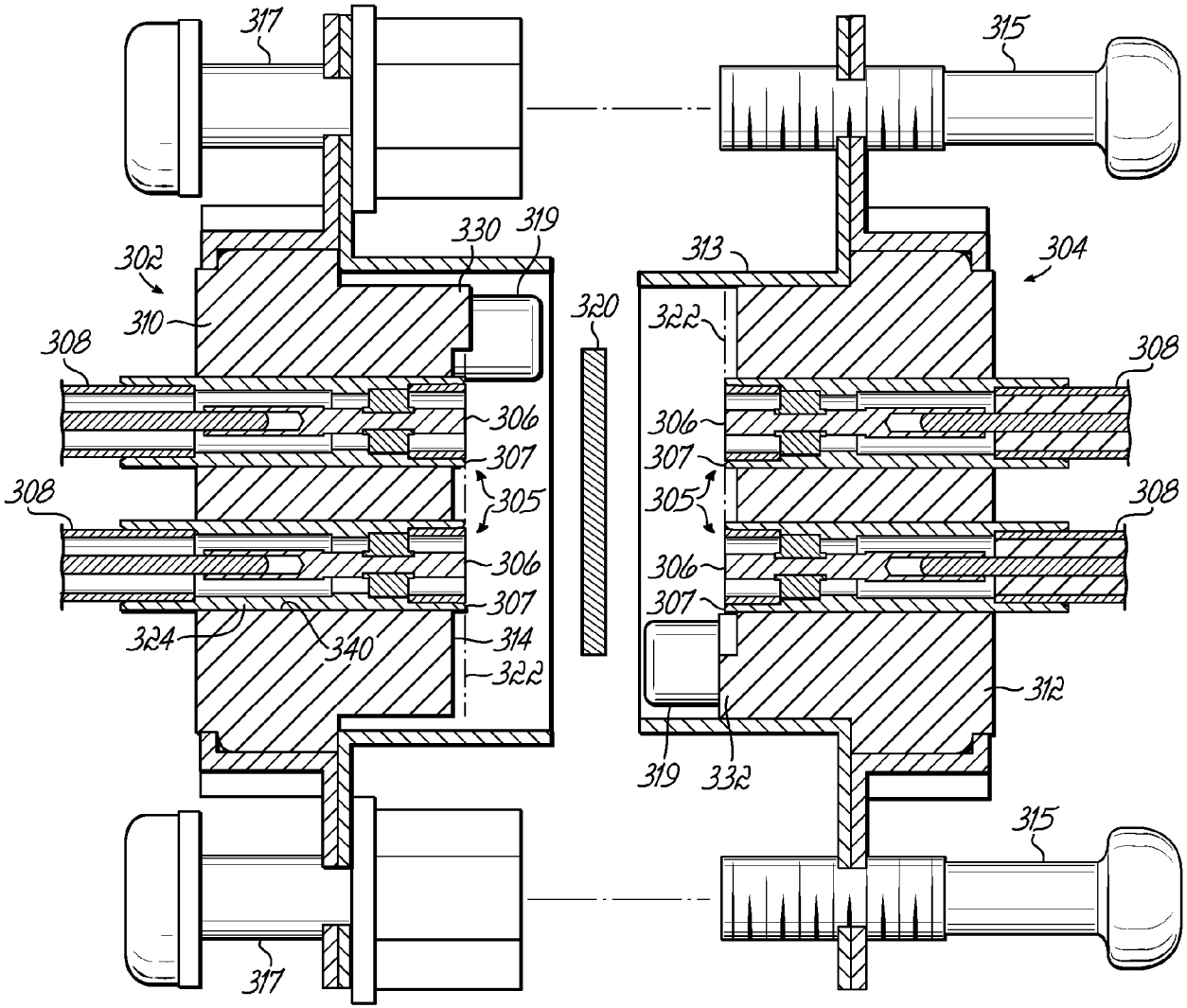
FIGS. 20A and 20B are cross-sectional views of the alternative connector assembly of FIG. 19.
Figure 19:
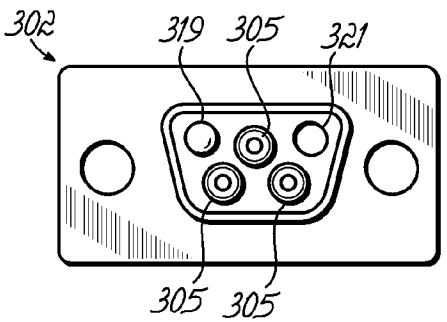
FIG. 19 is a front plan view of an alternative embodiment of a connector assembly.
Figure 20B:
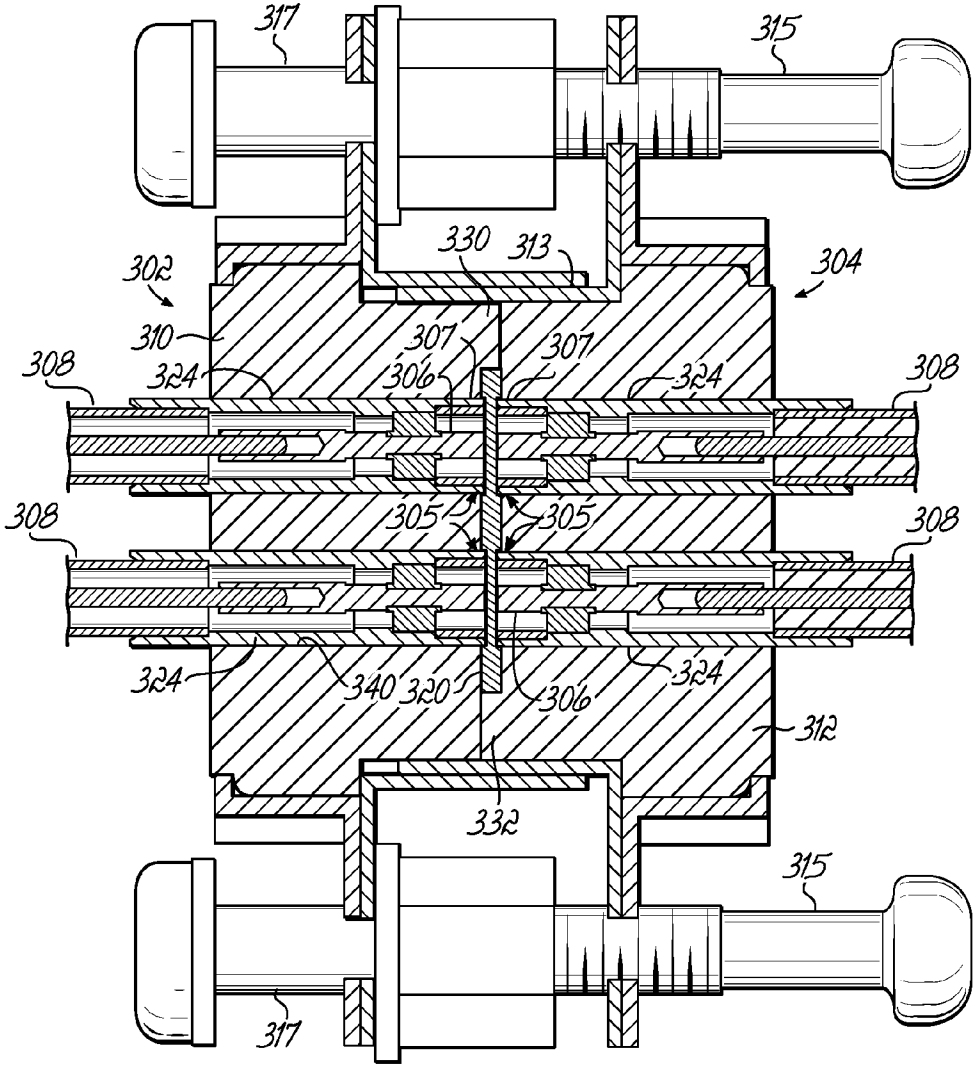

FIGS. 19 and 20A and 20B illustrate an alternative embodiment of the invention in the form of a connector assembly 300 that utilizes opposing signal arrays 302, 304. As illustrated in FIG. 19, each signal array has three conductors, although a greater or lesser number of conductors might be used for the arrays. Each of the signal arrays includes a plurality of conductors similar to the arrays in the connector assemblies discussed above wherein the conductors each include at least one inner conductive element 306 and an outer conductive element 307. The connector assembly 300 of FIGS. 19 and 20A, 20B is utilized to terminate a cable assembly, and thus, the plurality of conductors that form the array include cable elements 308. As noted above, the cable elements, in combination with other elements positioned within the respective connector bodies 310, 312 form inner conductive elements 306 and outer conductive elements 307 of the arrays for the passage and transmission of signals.

In the embodiments of FIGS. 19 and 20A, 20B, the connector bodies 310, 312 might be fabricated or formed from a non-conductive material, such as suitable engineering plastic, or other insulative material. The connector bodies each have or define a front surface 314, which surfaces capture the compressible interface element 320 therebetween in accordance with one aspect of the invention. The inner and outer conductive elements 306, 307 are electrically presented proximate the front surface, in a generally co-planar arrangement, as illustrated in FIGS. 20A, 20B. The connector bodies 310, 312 are housed in an appropriate housing 313, such as metal housing pieces, that may be appropriately brought together in a known male/female connector configuration. Appropriate fasteners, such as screws 315 and threaded receptacles 317, might be used to secure the connector bodies together to pass signals. One or more opposing alignment pins 319 and receptacles 321 may be used, as shown in the figures, to align the opposing connector bodies. The opposing connector housings are shaped (See FIG. 19) and sized for coming together in the proper fashion. As may be appreciated, other housing and connector body shapes may be used to facilitate the invention.

Each of the inner and outer conductive elements 306, 307 of an array terminates in a face surface or face plane 322 that is raised above the front surface 314 of the connector body 310, 312 for the respective array. In the embodiment illustrated in FIGS. 19 and 20A and 20B, the connector bodies are made of a plastic material, and thus, the outer conductive elements in the array are not formed by the respective bodies 310, 312 of the connector assembly 300, unlike the embodiments as illustrated in, for example, FIGS. 10, 11, and 12A-12C noted above.

Rather, as illustrated in FIGS. 20A and 20B, one or more conductive ferrules 324 is utilized. The ferrules 324 may be similar, for example, to the ferrule illustrated in FIG. 16, and thus, would include a conductive out body 260 and an inner contact 262 that are coaxially positioned, and separate by appropriate insulator elements 266 and bushings 268. The inner contact 262 and conductive outer body 260 of each ferrule defines generally the inner and outer conductive elements respectively of a conductor. Cable elements, such as cable elements 308, are terminated by the connector assembly 300, and, generally, the conductive outer body 260 is soldered or otherwise fixed to a shield or outer conductor of the cable elements 308. The inner contact 262 interfaces with the center conductor of the cable. As illustrated in FIG. 16, the inner contact might include a bifurcated end 263 that frictionally holds an exposed center conductor of the cable, as illustrated in FIGS. 20A and 20B. To define inner and outer conductive elements 306, 307 in the signal array that terminate in a face surface raised above the front surface of the connector body, the inner contacts 262 and conductive outer bodies 260 of the various ferrules extend forwardly or above the respective front surfaces 314 of the connector bodies, such that the inner contacts 262 and outer bodies 260 terminate in, and define, the face surface 322, above the respective front surfaces 314, as illustrated in FIGS. 19, 20A, 20B. In the embodiment illustrated in FIGS. 20A, 20B, the inner conductive elements are collectively formed by the cable center conductors and the inner contacts 262, whereas the outer conductive elements include the outer conductors or shields of the cables and the outer conductive bodies 260 of the ferrules. More or less elements might be used to form the conductors and the inner and outer conductive elements of the cable assembly of the invention.

In another aspect of the present invention, connector bodies 310, 312, include stop structures 330, 332, which also extend above the defined front surfaces 314 of the respective connector bodies. Referring to FIGS. 20A and 20B, when the respective signal arrays and connector bodies are brought together for connection, the stop structures 330, 332 abut the connector body front surface of an opposing array and limit compression of the compressible interface element between the opposing arrays. This thereby prevents overcompression and possible damage to the conductive elements of the compressible interface element 320, while ensuring proper signal passages through the conductors 305.

Referring to FIGS. 20A, 20B for containing the inner and outer conductive elements 306, 307, in proper relation at the front surfaces 314 of the various connector bodies, 310, 312, suitable openings or bores 340 are formed in the bodies, such as to receive the ferrules 324. The ferrules may be press-fit into the connector bodies, and secured by friction. Other alternative means of securing the ferrules might also be utilized, such as threading the ferrules into the body or utilizing an adhesive.

In accordance with one aspect of the invention, the inner and outer conductive elements terminate in the face surface or face plane 322 that is raised above a front surface of the connector body. To that end, the ferrules might be positioned to terminate in the face surface in the range of 2-5 microns above the front surface of the connector body so that the inner and outer conductive elements terminate as desired above the front surface, and can properly engage the interface element 320, as illustrated in FIG. 20B. Therefore, the face surface, and the conductive elements therein, are properly pressed into the interface element for good electrical contact when the opposing connector bodies are brought together.

Figure 21:
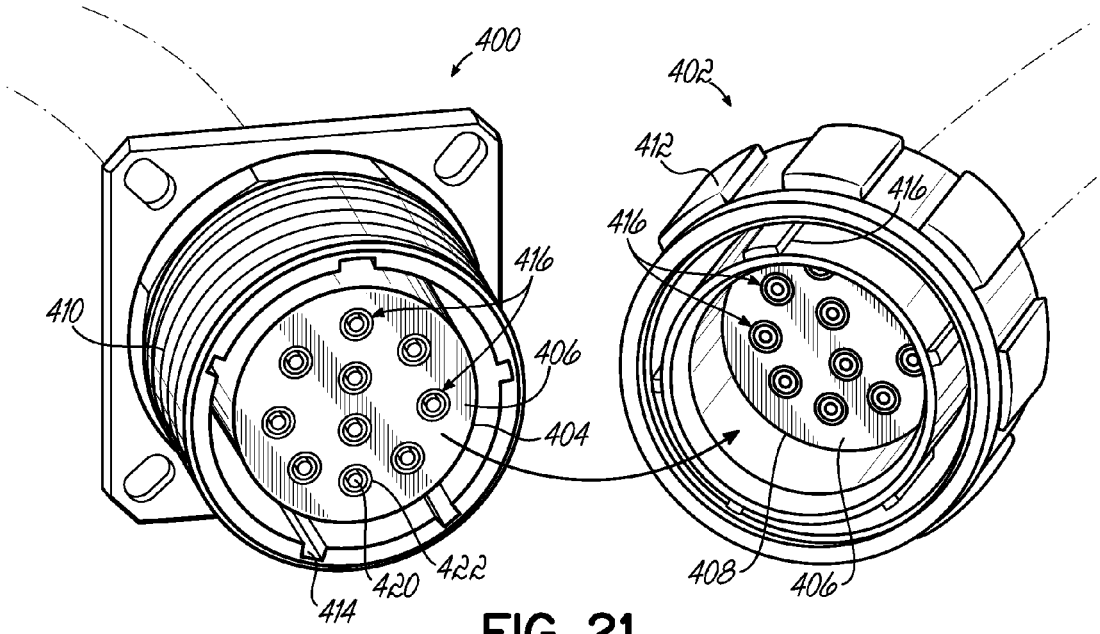
FIG. 21 is a perspective view of an alternative connector.
Figure 22:
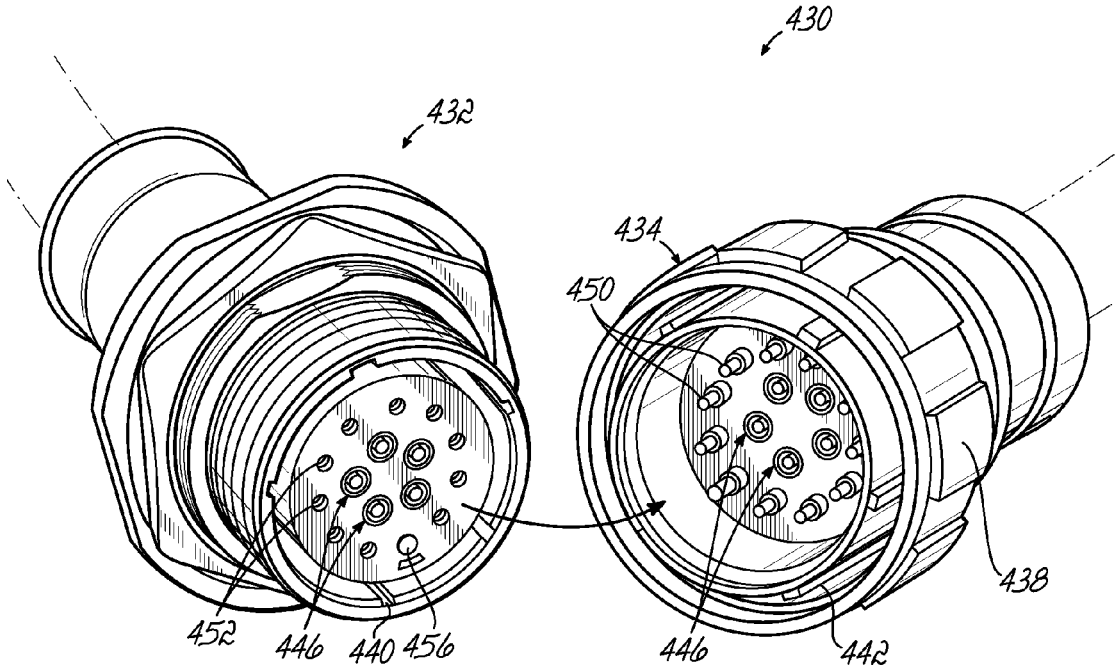
FIG. 22 is a perspective view of another assembly.

FIGS. 21 and 22 illustrate alternative embodiments of the invention that are constructed in accordance with aspects of the invention. In various of the embodiments noted above, RF signals are handled by the connector assemblies. However, it may be desirable to also address other signals or signal formats using the invention.

FIG. 21 illustrates a connector assembly for handling an RF signal format and includes two opposing signal arrays 400, 402, that incorporate conductors with inner and outer conductive elements that terminate in a face surface that is raised above a front surface of the connector body, for the respective array. Particularly, turning to array 400 in FIG. 21, a connector body 404 is illustrated and is formed of a suitable insulative plastic material, such as engineering plastic. The connector body 404 includes or defines a front surface 406 for capturing a compressible interface element (not shown in FIG. 21) for passing signals with an opposing connector body 408 of array 402. External threading structures 410, 412 might be utilized for securing the opposing connector bodies together. Also, appropriate slots 414 and guides 416 might be utilized for proper alignment of the individual conductors 415 of the respective arrays. The inner conductive elements 420 and the outer conductive element 422 for each conductor are raised above the front surface 406 in the respective arrays. As noted above, the inner and outer conductive elements 420, 422 define the face surface or face plane, which engages the interface element for passing signals between the signal arrays and maintaining a geometric arrangement of the inner and outer conductive element of the arrays, through the compressible interface element.

While FIG. 21 illustrates a connector assembly for passing primarily RF signals, such as RF data signals, FIG. 22 illustrates another embodiment of the invention wherein other signal types or formats are combined with the RF signals. In that way, multiple signal formats may be handled by the connector assembly 430 illustrated in FIG. 22. Specifically, a connector assembly includes a first array 432 and a second array 434, which may be secured together, utilizing appropriate threading structures 436, 438 and alignment slots and guides 442, for example. In addition to various RF conductors 446, the connector assembly 430 also includes additional conductors in the signal array for handling signals in a different format, such as DC signals and/or fiber-optic signals. For example, signal array 434 might include appropriate pins 450, whereas, signal array 432 includes appropriate receptacles or apertures 452 to receive the pins. The pins/receptacles might be used to pass DC signals. One or more of those pins, such as pin 454, might be a fiber-optic pin for passing a fiber-optic signal to another suitable fiber-optic element or socket 456. As may be appreciated, the compressible interfaced element (not shown in FIG. 22) would be appropriately sized to interface between the opposing conductors 446 and not to interfere with the appropriate pins 450, 454 and apertures 452, 456. That is, the other conductors (e.g. DC, fiber-optic) are spaced away from the RF conductors 446.

While FIGS. 21 and 22 illustrate embodiments of a connector assembly wherein various conductors are positioned in a somewhat circular array, other shapes and arrangements might also be utilized without deviating from the invention. In the illustrated example, the connector assembly 430 has front surfaces wherein the RF conductors that pass signals through the interface element are positioned proximate to a central area of the connector body and the additional non-RF conductors are positioned around a periphery of the central area, as shown in the figures. For such an arrangement, the interface element is positioned in the central area and does not interfere with the other conductors. However, other arrangements might also be utilized. Furthermore, other connector body shapes and other securing hardware might be utilized to hold the opposing connector bodies and arrays together in the connector assembly.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details of representative apparatus and method, and illustrative examples shown and described. Accordingly, departures may be made from such details without departure from the spirit or scope of applicant's general inventive concept.

What is claimed is:

1. A connector assembly comprising:

a signal array of a plurality of conductors, each conductor including at least one inner conductive element and an outer conductive element;

a connector body having a front surface wherein the inner and outer conductive elements are electrically presented proximate the front surface in a generally co-planar arrangement for presenting the signal array to a signal-bearing component;

the inner and outer conductive elements terminating in a face surface that is raised above the front surface of the connector body;

a compressible interface element having a plurality of conductive elements embedded in a compressible, electrically insulative medium;

the interface element positionable against the face surface, and operable, when compressed between the signal array and a signal-bearing component, to pass signals between the signal array and the signal-bearing component while maintaining geometric arrangement of the inner and outer conductive elements of the conductors of the array and conductive elements of the signal-bearing component.

2. The connector assembly of claim 1 wherein the connector body is metal and forms a metal front surface, the face surface being another metal surface formed to extend above the metal front surface of the body.

3. The connector assembly of claim 2 further comprising at least one of a recess or milled out area formed in the face surface and extending in a direction toward the front surface.

4. The connector assembly of claim 1 wherein the face surface has openings therein formed through the body, the inner conductive elements terminating in the face surface through respective openings.

5. The connector assembly of claim 1 wherein the inner conductive element is surrounded by at least one of a dielectric material or air.

6. The connector assembly of claim 1 wherein the conductive body is formed of a nonconductive material and further comprising a ferrule having an inner contact and a conductive outer body for forming the inner and outer conductive elements, respectively, of a conductor;

the inner contact and outer body terminating in the face surface above the front surface of the connector body.

7. The connector assembly of claim 6 further comprising a dielectric element surrounding the inner contact and electrically isolating the inner contact from the outer body.

8. The connector assembly of claim 1 further comprising additional conductors in the signal array, the additional conductors positioned away from the interface element and configured to pass one of a DC signal or a fiber-optic signal apart from the signals passed by the interface element.

9. The connector assembly of claim 8 wherein the additional conductors include at least on of a pin and a receptacle for receiving a pin.

10. The connector assembly of claim 8 wherein the conductors passing signals through the interface element are positioned proximate a central area of the connector body front surface and the additional conductors are positioned around the periphery of the central area.

11. A connector assembly comprising:

opposing signal arrays, each including a plurality of conductors, the conductors each including at least one inner conductive element and an outer conductive element;

each signal array including a connector body having a front surface wherein the inner and outer conductive elements are electrically presented proximate the front surface, in a generally co-planar arrangement;

the inner and outer conductive elements of the arrays terminating in a face surface that is raised above the front surface of the connector body for the respective array;

a compressible interface element having a plurality of conductive elements embedded in a compressible, electrically insulative medium;

the interface element positionable between the face surfaces of the connector bodies of the opposing arrays, and operable, when compressed therebetween, to pass signals between the signal arrays and maintain a geometric arrangement of the inner and outer conductive elements of the arrays through the interface element.

12. The connector assembly of claim 11 wherein the connector body of an array is metal and forms a metal front surface, the face surface being another metal surface formed to extend above the metal front surface of the body.

13. The connector assembly of claim 11 further comprising at least one of a recess or milled out area formed in the face surface and extending toward the front surface of the connector body.

14. The connector assembly of claim 11 wherein the face surface of a connector body has openings therein formed through the body, the inner conductive elements terminating in the face surface through respective openings.

15. The connector assembly of claim 11 wherein the inner conductive elements are surrounded by at least one of a dielectric material or air.

16. The connector assembly of claim 11 wherein the connector body of an array is formed of a nonconductive material and further comprising a ferrule having an inner contact and a conductive outer body electrically coupled with the inner and outer conductive elements, respectively, of a conductor;

the inner contact and outer body terminating in the face surface above the front surface of the connector body.

17. The connector assembly of claim 16 further comprising a dielectric element surrounding the inner contact and electrically isolating the inner contact from the outer body.

18. The connector assembly of claim 11 wherein a connector body of at least one array includes a stop structure which extends above the front surface of the connector body to abut the connector body of an opposing array and limit compression of the compressible interface element when the opposing arrays are brought together.

19. The connector assembly of claim 11 further comprising additional conductors in the signal array, the additional conductors positioned away from the interface element and configured to pass one of a DC signal or a fiber-optic signal apart from the signals passed by the interface element.

20. The connector assembly of claim 19 wherein the additional conductors include at least on of a pin and a receptacle for receiving a pin.

21. The connector assembly of claim 19 wherein the conductors passing signals through the interface element are positioned proximate a central area of the connector body front surface and the additional conductors are positioned around the periphery of the central area.

22. A connector assembly comprising:

a signal array of a plurality of conductors, each conductor including at least one inner conductive element and an outer conductive element;

a connector body having a first surface wherein the inner and outer conductive elements are electrically presented proximate the first surface in a generally co-planar arrangement;

the inner conductive elements terminating at a second surface that is raised above the first surface of the connector body;

a compressible interface element having a plurality of conductive elements embedded in a compressible, electrically insulative medium;

the interface element positionable against the face surface, and operable, when compressed between the signal array and a signal-bearing component, to pass signals between the signal array and the signal-bearing component while maintaining geometric arrangement of the inner and outer conductive elements of the conductors of the array and conductive elements of the signal-bearing component.

23. The connector assembly of claim 22 further comprising a circuit board, the connector body interfaced with an edge of the circuit board, the inner conductive elements coupled with traces on the circuit board.

24. The connector assembly of claim 23 further comprising a terminating element having a conductive outer body coupled to each of the conductors, the terminating element outer body providing the outer conductive element of the array.

25. The connector assembly of claim 24 further comprising an insulator element positioned around the inner conductive element to isolate the inner conductive element from the outer body.

* * * * *